US008499979B2

(12) United States Patent
Sand

(10) Patent No.: US 8,499,979 B2
(45) Date of Patent: Aug. 6, 2013

(54) CHEMICAL DISPENSING APPARATUS AND METHODS

(75) Inventor: William F. Sand, Cincinnati, OH (US)

(73) Assignee: Delaware Capital Formation, Inc., Wilmington, DE (US)

( * ) Notice: Subject to any disclaimer, the term of this patent is extended or adjusted under 35 U.S.C. 154(b) by 91 days.

(21) Appl. No.: 13/223,534

(22) Filed: Sep. 1, 2011

(65) Prior Publication Data

US 2011/0315714 A1 Dec. 29, 2011

Related U.S. Application Data

(63) Continuation-in-part of application No. 12/899,143, filed on Oct. 6, 2010.

(60) Provisional application No. 61/278,504, filed on Oct. 7, 2009, provisional application No. 61/402,599, filed on Sep. 1, 2010.

(51) Int. Cl.
*B67D 7/74* (2010.01)

(52) U.S. Cl.
USPC ..... 222/173; 222/129.1

(58) Field of Classification Search
USPC ..... 222/173, 180, 183, 129.1, 131, 138–144; 220/843–845; 16/231–263
See application file for complete search history.

(56) References Cited

U.S. PATENT DOCUMENTS

| | | | | |
|---|---|---|---|---|
| 6,105,606 | A * | 8/2000 | Jackson | 137/376 |
| 6,234,354 | B1 * | 5/2001 | Phillips et al. | 222/129.1 |
| 6,276,404 | B1 * | 8/2001 | Birtcher et al. | 141/1 |
| 6,540,819 | B2 * | 4/2003 | Tom et al. | 96/108 |
| 6,981,615 | B2 * | 1/2006 | Tobler | 222/129.1 |
| 7,065,832 | B2 * | 6/2006 | Pohl | 16/235 |
| 7,334,595 | B2 * | 2/2008 | Birtcher et al. | 137/15.04 |
| 7,621,022 | B2 * | 11/2009 | Gandevia et al. | 16/385 |
| 2006/0168760 | A1 * | 8/2006 | Espindola et al. | 16/374 |

* cited by examiner

*Primary Examiner* — Lien Ngo
(74) *Attorney, Agent, or Firm* — Wood, Herron & Evans, LLP

(57) ABSTRACT

Improvements in modular dispenser and chemical source cabinets include field-replaceable door hinges, field-serviceable dispenser manifolds, removeably mounted in the modular dispenser cabinets, and rotating water inlet fittings to facilitate interconnection to a water source and the placement of chemical cabinet modules in close proximity. These features are used together or separately and preferably with customizable rail mounting elements.

2 Claims, 38 Drawing Sheets

CHEMICAL DISPENSING APPARATUS AND METHODS

PRIORITY

This application is a Continuation-in-Part of U.S. patent application Ser. No. 12/899,143 filed Oct. 6, 2010 and which claimed benefit of U.S. provisional patent application Ser. No. 61/278,504, filed Oct. 7, 2009. Applicant also claims the benefit of U.S. Provisional Patent Application Ser. No. 61/402,599, filed Sep. 1, 2010. Said two provisional applications and said parent utility application are expressly incorporated herein by reference.

FIELD OF THE INVENTION

Building and facility management require many considerations to keep a building in repair and clean. Lawn service, heating and air-conditioning and general repairs are a few. One maintenance service that is usually done on a daily basis is cleaning. In some instances such as for restaurants or hotels, this cleaning task is performed many times throughout the day. The individuals who perform these tasks must use a variety of chemical cleaners to accomplish their tasks easily and efficiently. These chemical cleaners are typically mixed from concentrates by chemical mixing systems and dispensers. These systems are supplied by a number of chemical mixing system manufacturers such as, Hydro Systems Co., Dema Engineering Co and Knight Manufacturing Company. Each of these companies makes chemical mixing systems that are installed in the various commercial buildings.

BACKGROUND OF THE INVENTION

Chemical mixing systems typically include a dispenser which is enclosed in a housing or cabinet. In addition to the dispenser, the mixing system may provide additional space to accommodate or store concentrated chemical containers. Such systems may also comprise several cabinets, one or more for dispensers and a plurality of further cabinets to hold the chemical concentrates. These units are typically installed in janitors' closets and kitchens. These closets are small but nevertheless are required to store a variety of materials and implements. The closets may include shelves for storing said materials. Available space for mounting chemical mixing systems in these areas is usually at a premium.

There are systems on the market now that include combinations of dispensing units and chemical container enclosures. Some of these systems are produced by the Hydro Systems Co., Cincinnati, Ohio. An example would be apparatus marketed under the mark "Maximizer". Another example is produced by Dema Engineering, St. Louis Mo. under the model number 803GAP-Q2L or 804GAPRF-Q2L. These dispensing systems all incorporate a dispenser and an enclosure for the chemical. These units are typically built in the factory and shipped as a single unit. Since these products are built in the factory they tend to be large and frequently fit a specific need or requirement. Many of these units have to be custom built in order to meet the parameters of the space in which it will be mounted and of the particular dispenser specifications of the customer. The time required by the manufacturer to assemble custom units adds to the delivery time of the unit. Since the units are shipped as a completed unit they typically cannot be reconfigured in the field to suit the unique installation requirements of each facility, thus creating the need to order additional units with different spatial configurations, increasing the time to get the product installed in the space available.

Accordingly, the mounting of mixing or dispensing cabinets and chemical container enclosures presents significant concerns addressed usefully in U.S. Provisional Patent Application Ser. No. 61/278,504, filed Oct. 7, 2009, and the succeeding U.S. patent application Ser. No. 12/899,143, filed Oct. 6, 2010, both incorporated herein by reference.

In addition to the mounting aspects of mixing, dispensing and chemical containment cabinets as noted above, such systems present further concerns to a user, including issues relating to the function of the cabinets themselves, to the accessibility of the system elements in the cabinet for field maintenance and repair, and to location and orientation of the operable system components which may interfere with the placement of the system cabinet or the close placement of an adjacent cabinet. Thus, not only is the cabinet mounting a problem when space is limited, but the accessibility of the cabinet contents for repairs and flexibility of operational components therein to more efficiently accomplish cabinet placement without interference from operational orientation of the mixing or dispensing elements is one concern.

More particularly, it is noted that such cabinets typically provide doors which can be easily broken off from the cabinet or ruptured, particularly when the doors are stressed as might occur when a user attempts to manipulate them when on a cabinet located in a restricted space or tight environment. Opening the cabinet door to insert or remove or change chemical containers therein can easily stress the door hinges, causing them to break off, crack or rupture.

In addition, it will be appreciated that a chemical mixing and dispensing apparatus for one use may require wholly different valves or other components than for another use. Thus, in the past, a cabinet design required attention to the specific application and numerous cabinets were required to be made and provided for a variety of different applications. This increased manufacturing cost and the cost of inventory necessary to meet customer needs for a variety of applications.

Accordingly, it is one objective of the invention to provide easily replaceable cabinet hinges which do not require entire cabinet or door replacement of a hinge, if broken.

A further objective of the invention has been to provide a field serviceable mixing or dispensing assembly easily mounted and easily removable from the cabinet for maintenance, repair or replacement.

Another objective of the invention has been to provide a flexible mixing and dispensing unit having operable components placeable in various cabinet orientations to provide and enhance the mounting of the cabinet efficiently where limited space is included.

Another objective of the invention has been to provide components of a mixing and dispensing system which further enhance the modular cabinet mounting system of that disclosed in parent U.S. patent application Ser. No. 12/899,143, filed Oct. 6, 2010, incorporated herein by reference.

A yet further objective of the invention has been to provide an enhanced chemical mixing and dispensing apparatus which increases the utility and versatility of such systems in restricted spaces and environments.

It is a further objective of the invention to provide a chemical mixing and dispensing apparatus accommodating the selective uses of a variety of chemicals, spatial mounting situations and modularity, without requiring a multiplicity of different cabinet designs and sizes, such that a single cabinet and component features can be useful in a wide variety of applications.

It is a further objective of the invention to provide a highly customizable cabinet capable of handling a wide variety of valves and providing enhanced access for easy repair and maintenance.

SUMMARY OF THE INVENTION

To these ends and in summary, a preferred embodiment of the invention includes a novel field-replaceable, tool-less door hinge, a manifold assembly for supporting the valves and manifolds of the system, which is releasably mounted without tools to provide easier removal from the cabinet for service, and a rotatable water inlet apparatus providing a variety of water inlet orientations to accommodate operable access to the cabinet in a variety of mounting configurations, particularly in restricted space environments, and without interfering with other internal components.

More specifically, a preferred embodiment of the invention contemplates one or more of the following:

A Field Removable Door Hinge that does not Require Tools:

Typically doors on chemical enclosures are metal hinges or molded in hinges with steel rods to connect the two parts. If the hinge breaks in the field, the complete cabinet assembly is replaced. With the new hinge, the hinge is manufactured as the weakest part of the system. If the hinge breaks, it can be removed without the use of tools and without uninstalling the cabinet. The hinge is only removable when the door is open. If the door is closed and locked, the hinge is secure.

A Field Serviceable Manifold Assembly:

Water manifolds and associated water valves and educators are usually mounted in the dispenser cabinet with screws. If the manifold or other components need to be serviced or replaced, tools are required to remove the manifold from the dispenser. In many cases, the entire dispenser must be removed from the wall (uninstalled) in order to remove the screws that hold the manifold in place.

The new system includes a manifold mounted to a carrier. The carrier snaps into the dispenser cabinet without the use of tools. The manifold carrier assembly can be removed from the cabinet without use of no tools. This allows easier serviceability and also permits the manifold/carrier assembly to be removed from the dispenser during installation, thus permitting easier installation.

A Rotating Water Inlet Fitting:

Most chemical dispensing systems are designed with the water inlet fitting external to the dispensing cabinet. Outwardly extending water fittings do not permit chemical enclosures to be mounted closely adjacent the chemical dispenser. Some systems, for example, have a water supply that enters the chemical dispenser from the side of the unit, or even from the bottom of the unit, thus not permitting adjacent or abutting integral chemical enclosure next to the dispensing portion of the device. The new dispenser alleviates the problem of the water inlet coming into the side of the unit by having the inlet hose come from the bottom of the unit. This is not new to the industry. But, since the hose attachment is typically inside the cabinet, along with water valves and other parts, it is sometimes difficult to attach the inlet hose to the fitting. Many times, small cuts to hands are incurred during the installation of this type of product.

The rotating water inlet fitting solves the above issues by permitting the inlet fitting to extend outwardly for connecting to a hose, then rotated out of the way of other internal components, thus allowing for a safer and quicker installation of the chemical dispensing system.

These variable elements can all be combined, or included independently and separately from the others, providing their own exclusive performance benefits as needed.

Accordingly, what is needed is a dispensing and source storage system which can be configured and easily mounted at the point of use to serve a variety of dispensing applications without the space, mounting and optional issues noted above, thus reducing or eliminating the need for "custom" systems. The invention satisfies this need.

In addition, the features of the invention disclosed herein can be used with the cabinet mounting features described in the aforesaid parent patent application and in combination or separately as desired.

Accordingly, this invention addresses the issues of mountability and configurability, that is, the ability to standardize, yet install the system components in different ways at the point of use, and without individual customization. It also addresses the issue of safety and pilferage of material by locking the system components to the wall without the use of additional screws. In addition, the mounting system, permitting lateral mounting without vertical motion, allows zero clearance mounting to adjacent obstructions. The ability to build the system on site rather than at the manufacturer reduces the number of parts that need to be inventoried thus reducing costs. And the ability to repair the door hinges, service the valves and access the water inlet as noted provides significant operational and cost advantages in such systems.

BRIEF DESCRIPTION OF THE DRAWINGS

FIGS. 1-15D illustrate the modular mounting features of the invention. FIGS. 16-29B illustrate three additional components of the invention disclosed in even more detail herein.

FIG. 1 is an isometric view of a dispenser and universal mounting rail of a preferred embodiment of the invention;

FIG. 2 is a rear view of the dispenser module, mounted to a dispenser mounting rail as in FIG. 1 and showing a mounting lock;

FIG. 3 is a sectional view of a rear portion of the dispenser of FIG. 1, taken along lines 3-3 of FIG. 1, similar to FIG. 2, and showing the mounting lock pivoted for disengagement as shown in phantom in FIG. 2;

FIG. 4 is sectional view similar to FIG. 3 but showing the mounting locks pivoted to a locking position;

FIG. 6 is a view similar to FIG. 5A but showing an interconnected composite rail;

FIG. 8 is a cut-away isometric view similar to FIG. 7A showing both mounting locks engaged with a rail;

FIG. 10 is an isometric view of a dispenser cabinet and two concentrated chemical cabinets as would be mounted on the rail grid of FIG. 9C;

FIG. 11 is an isometric illustration of an alternative rail grid configuration;

FIGS. 15A-15D are further elevational views illustrating further module mounting orientations;

FIG. 16 is an isometric view of a chemical source cabinet according to the invention and having field replaceable hinge members, with the door closed;

FIG. 17 is a view similar to FIG. 16 but with the door opened;

FIG. 18 is an isometric view of one embodiment of a field-replaceable hinge member according to the invention, shown with exploded door, cabinet and hinge components;

FIG. 19 is an isometric view showing a lower field replaceable hinge in more detail;

FIG. 20 is an elevational cross-sectional view of the hinge member, door portion and cabinet portion illustrating the coordination and orientation of the components of FIGS. 17-19;

FIG. 21 is an isometric view of the top field replaceable hinge of FIGS. 16, 17 and 18;

FIG. 22 is an isometric view of the top hinge of FIG. 21, showing also upper portions of the door and cabinet of FIGS. 16, 17 and 18;

FIG. 23 is a cross-sectional, isometric upward view of a top hinge member;

FIG. 24 is an isometric view of a chemical dispenser module or cabinet having the releasable bracket and manifold of the invention;

FIG. 25 is an isometric view of the module of FIG. 24, but with the door removed for clarity of illustration of the manifold and manifold bracket removed outwardly for clarity;

FIG. 28 is an isometric view of a dual chemical manifold cabinet according to the invention;

FIG. 29B is a view similar to FIG. 29A but showing the water inlet member in a non-vertical rotated position extending outwardly of the cabinet.

DETAILED DESCRIPTION OF THE INVENTION

Turning now to the figures, FIGS. 1-15D illustrate the modular mounting components of the invention such as disclosed in prior U.S. Provisional Patent Application Ser. No. 61/278,504 filed Oct. 7, 2009, and in parent U.S. Utility application Ser. No. 12/899,143, filed Oct. 6, 2010, both incorporated herein by reference.

It will be appreciated the modules referred to herein may house or support either a chemical source or a dispensing apparatus which may include a diluent connector (water inlet), a selector valve, a proportioner or educator and a depending discharge spout, all operably interconnectable through respective tubing or conduits to a diluent source and to concentrated chemical sources. Such components are themselves separately well known.

Figure 1:
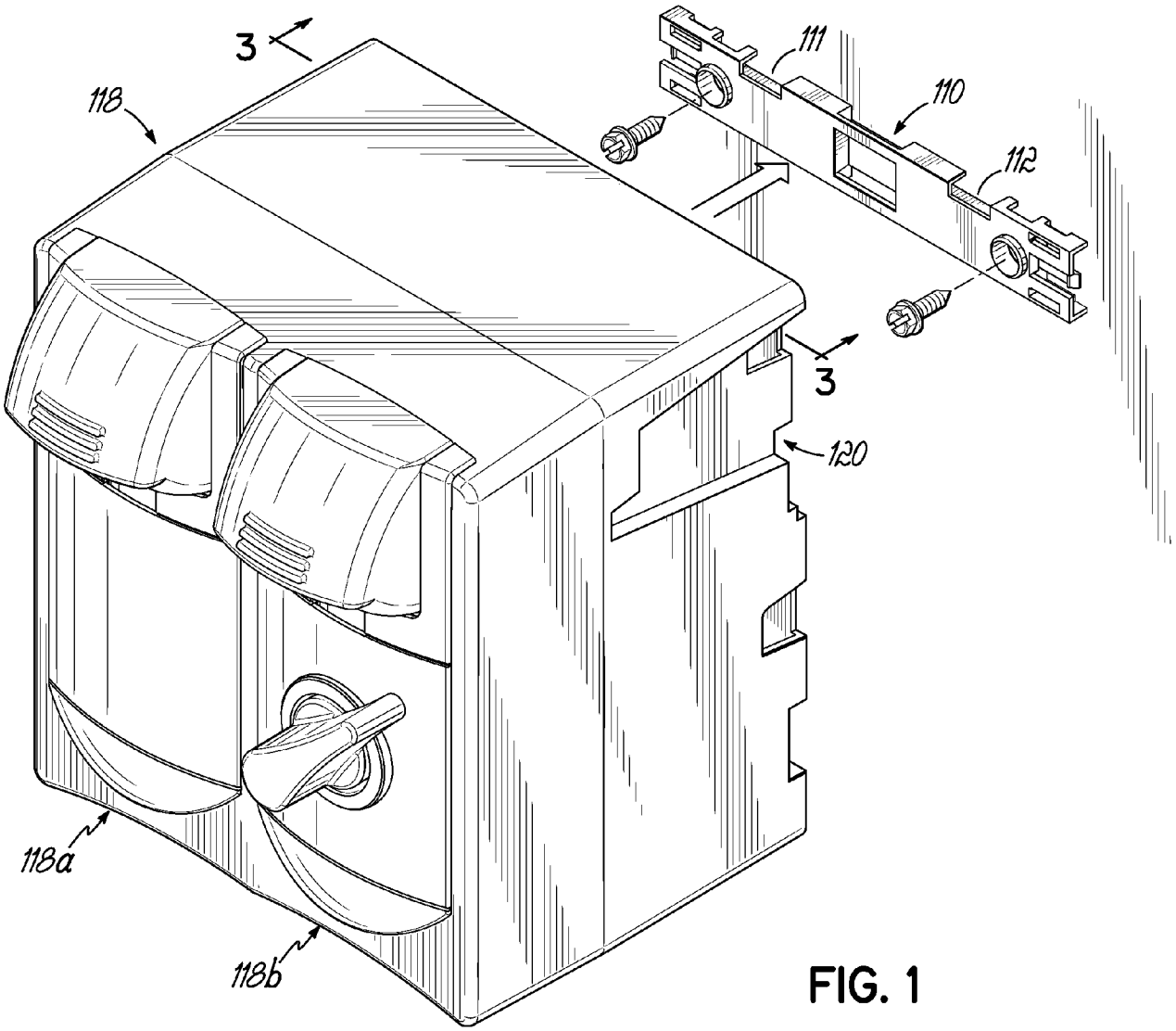

A single dispenser mounting rail is shown in FIG. 1 and has two lock notches 111, 112 or openings providing access to the cabinet locks to be described. Lock notches 111*a*, 112*a* (not shown in FIG. 1) are provided in the underside of the rail 110 and are similar to notches 111, 112 to accommodate rotatable latches extending into the bottom of the rail where desired. Notches 111, 112, 111*a* and 112*a* are oriented to accommodate locks 124 in the respective modular cabinets as shown. Screws applied through holes as shown secure the rail to a wall surface. The view of FIG. 1 illustrates the front of rail 110 to which a cabinet component as shown will be applied.

Figure 2:
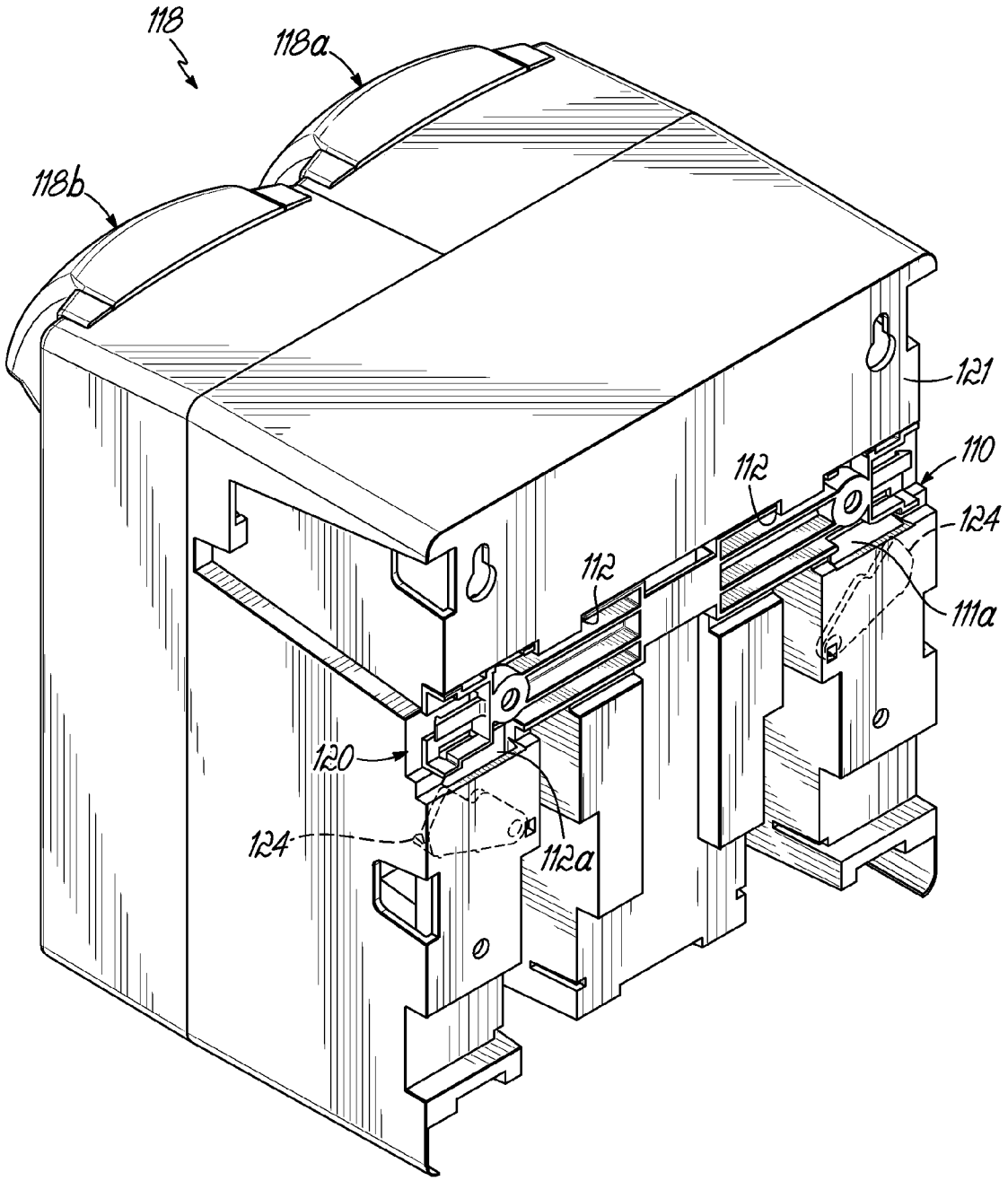
Figure 3:
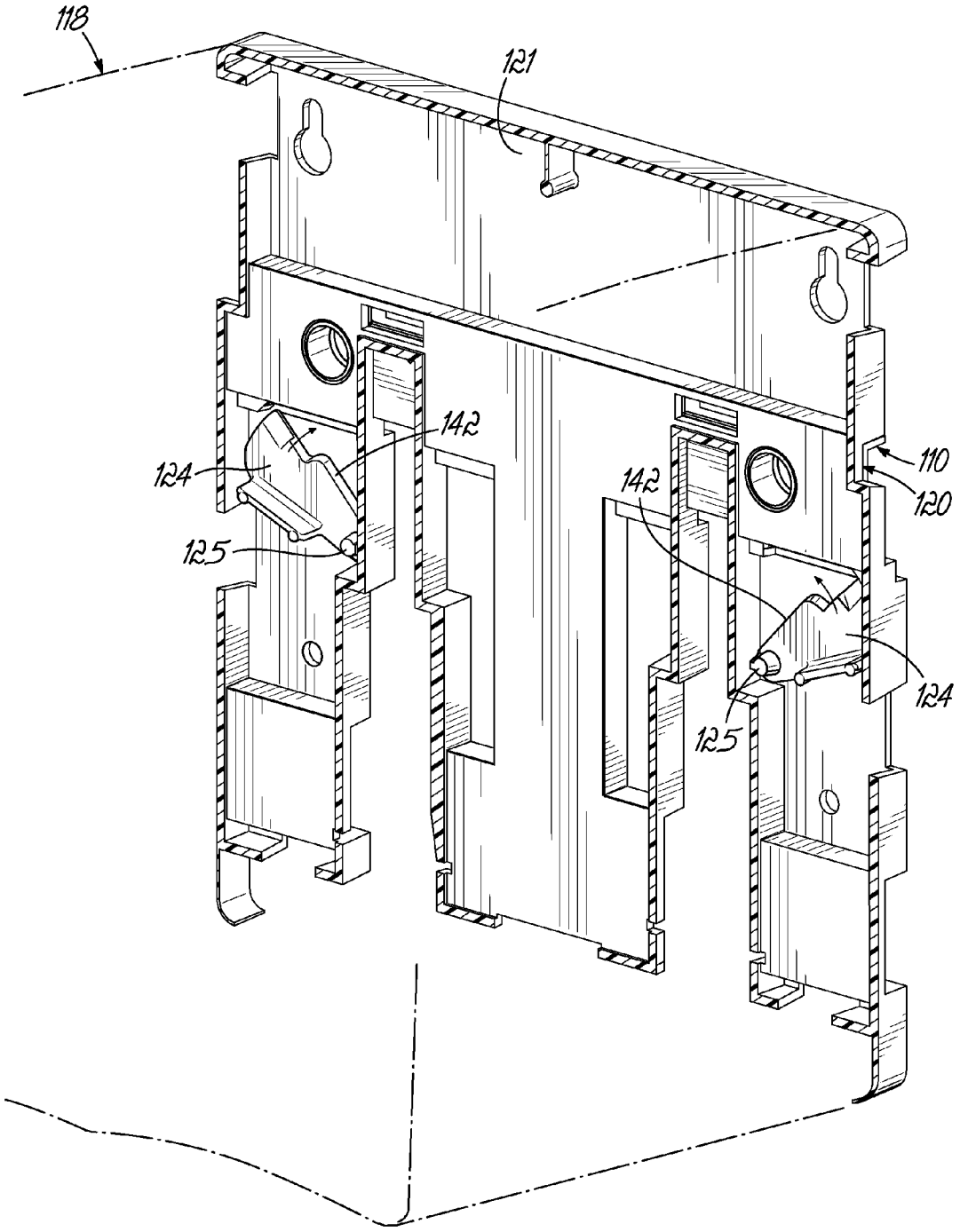

FIGS. 1 and 2 illustrate a dispenser cabinet assembly or module 118 in isometric view for mounting on a dispenser mounting rail 110 (spaced apart in FIG. 2). A mounting channel 120 is formed in the rear wall 121 of this module 118 to accommodate the rail 110. Upon assembly, the module 118 is moved rearwardly in a horizontal motion onto the rail 110 which is secured to a wall. One rotatable mounting lock 124, pivoted about lock pin 125, is shown here, the lock 124 rotated to disengaged position under a rail 110.

It will be appreciated that module 118 may house or support a dispensing apparatus which may include a diluent connector, a selector valve, a proportioner and a depending discharge spout, all operably interconnectable through respective tubing to a diluent source and to concentrated chemical sources. Such components according to the invention are shown in later figures.

Figure 4:
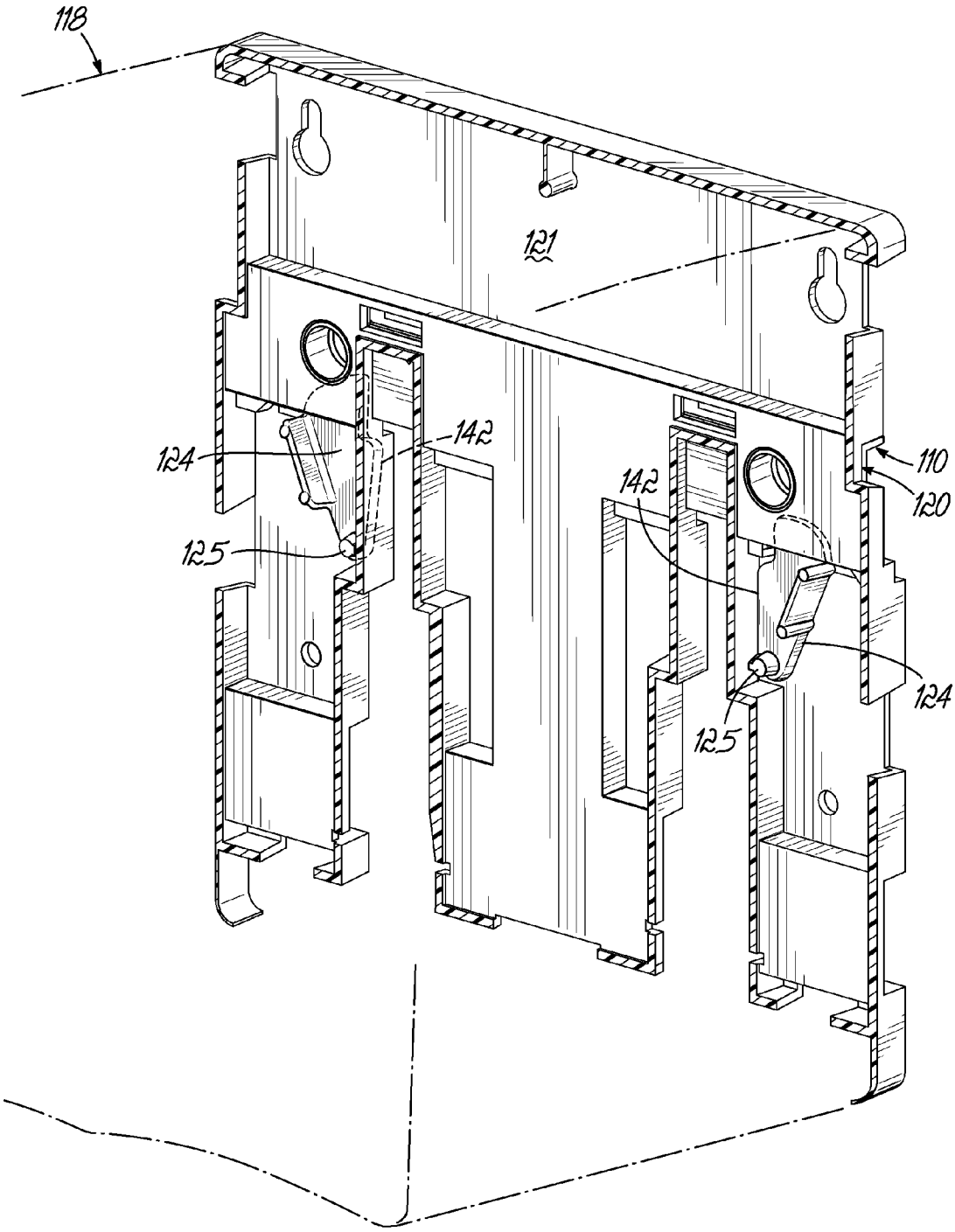

FIG. 4 illustrates the dispenser assembly or module 118 with locks 124 rotated to engaged position with rail 110 when module 118 is mounted thereto.

Figure 5A:
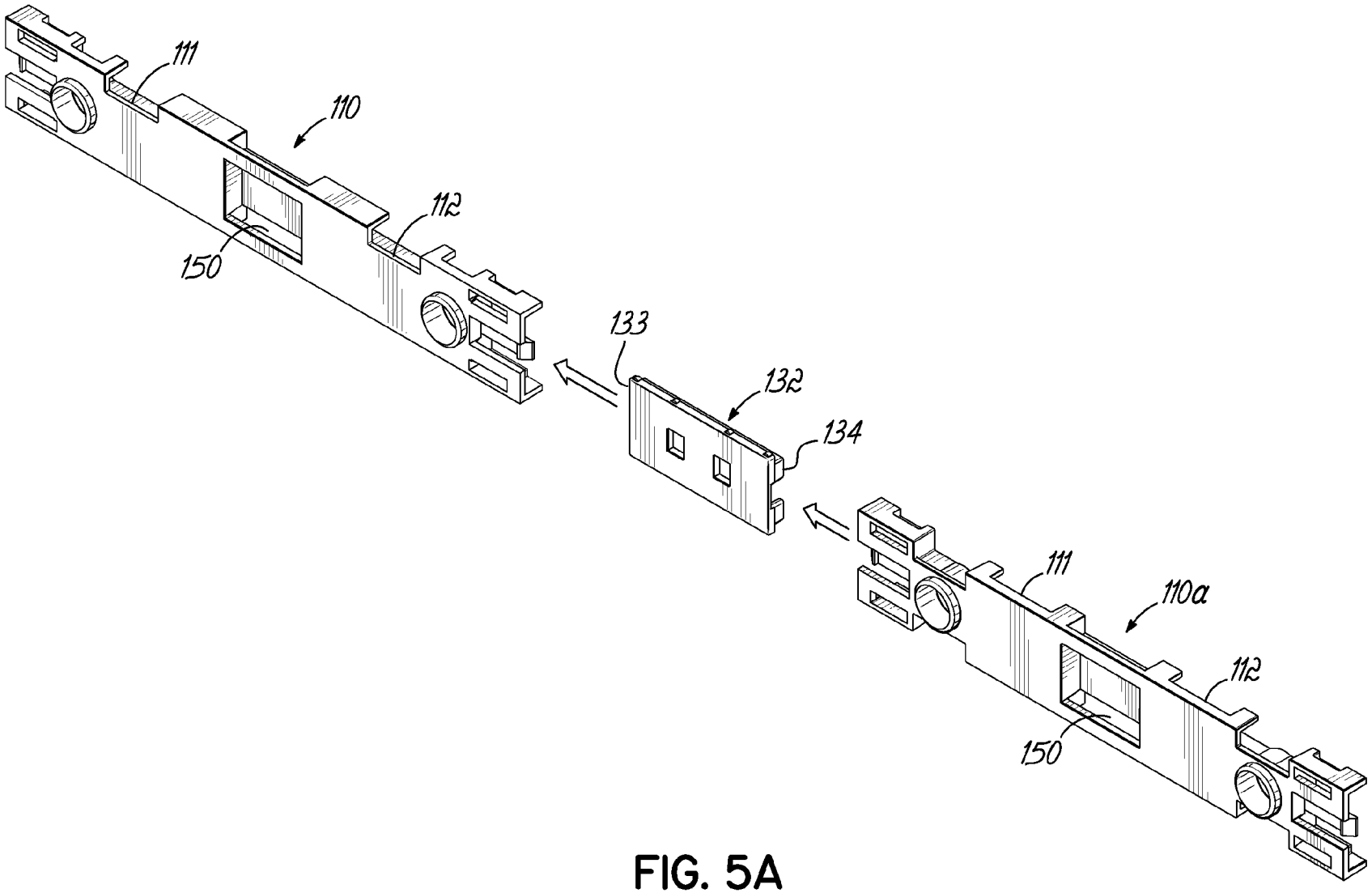
FIG. 5A is affront exploded view of a composite chemical cabinet mounting rail as in FIG. 4, using the rail of FIG. 1 as a component and showing the rail from its front.
Figure 5B:
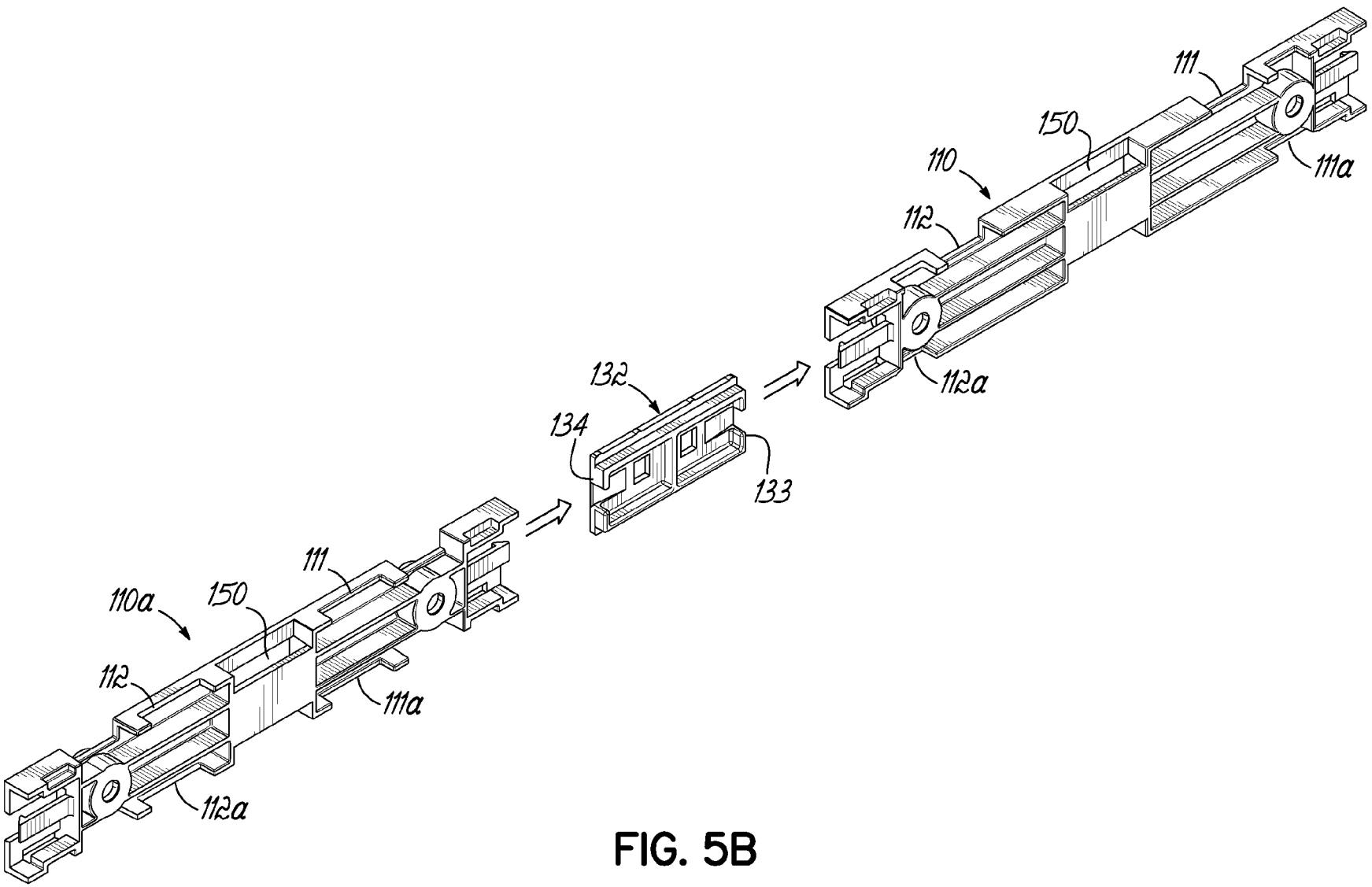
FIG. 5B is a rear isometric of the rail of FIG. 5A but showing the composite rail from its backside.
Figure 6:
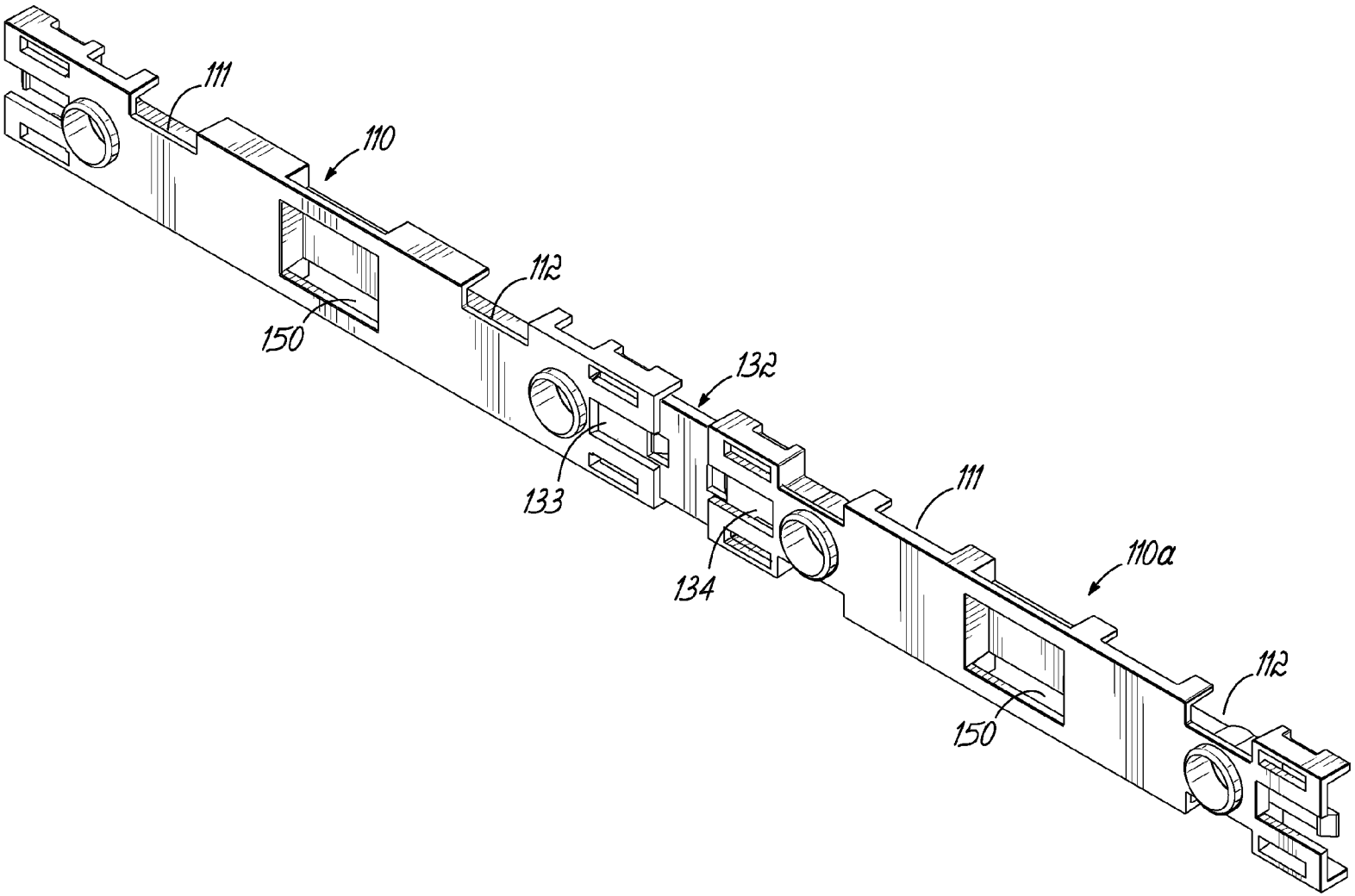

FIGS. 5A, 5B and 6 show a composite mounting grid according to the invention in exploded format including a dispenser mounting rail 110, chemical cabinet mounting rail 110*a* and horizontal connector 132. See FIG. 5B for a rear view (from the wall side) of the composite mounting rail 110, 110*a*, 132. The connector 132 (see FIGS. 5A, 5B) has ends 133, 134 which are releasably connectable to abutting ends of the respective rails 110, 110*a* in any suitable fashion. When interconnected, such as by snapping these components together, a formed horizontal grid is formed as in FIG. 6. It will be appreciated that rails 110, 110*a* are very similar with only slight spacing differences as shown, one rail being configured for a dispenser cabinet or module and the other rail configured for a chemical source cabinet or module, as desired.

It will be appreciated that horizontal mounting rails 110, 110*a* do not extend outwardly of the width profile of the modular cabinet or dispenser they respectively mount. When side-by-side module mounting is desired, the connectors 132 are used to properly space the respective mounting rails for side-by-side cabinet orientation and the rails 110, 110*a* do not protrude outwardly of the cabinet width profile.

Moreover, note the lock notches 111*a*, 112*a* of the module mounting rail 110*a* (FIG. 5B) which provide clearance for any upwardly rotatable rail locks 124 as will be described, Lock notches 111, 112 and 111*a*, 112*a* are similar in the respective rails.

Two different locks 124 are shown in the FIGS. In FIGS. 1-5B, locks 124 turn upwardly to engage a respective mounting rail. Alternately, in FIGS. 7A-8, locks 124A turn downwardly to engage a mounting rail through lock notches 111, 112. While in the embodiment shown, locks 124 of a dispenser module rotate onto the rails from below and locks 124 of the chemical source cabinet rotate onto the rails from above, either orientation of locks 124 can be used in the respective modules, providing available room in the module molds.

Figure 7A:
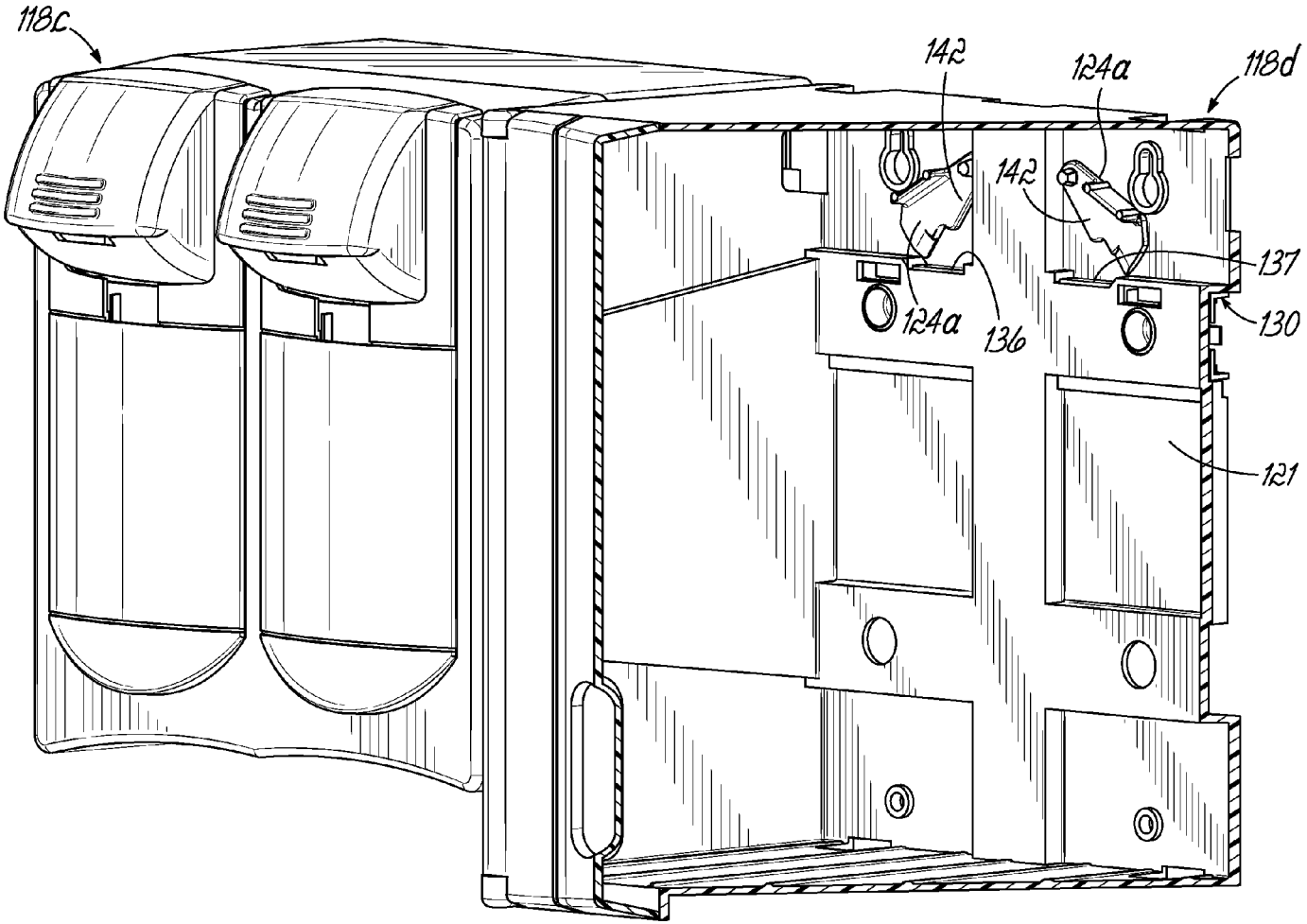
FIG. 7A is an isometric line drawing of side-by-side cabinets with a cut-away view of one cabinet and respective rail locks, in disengaged position.
Figure 7B:
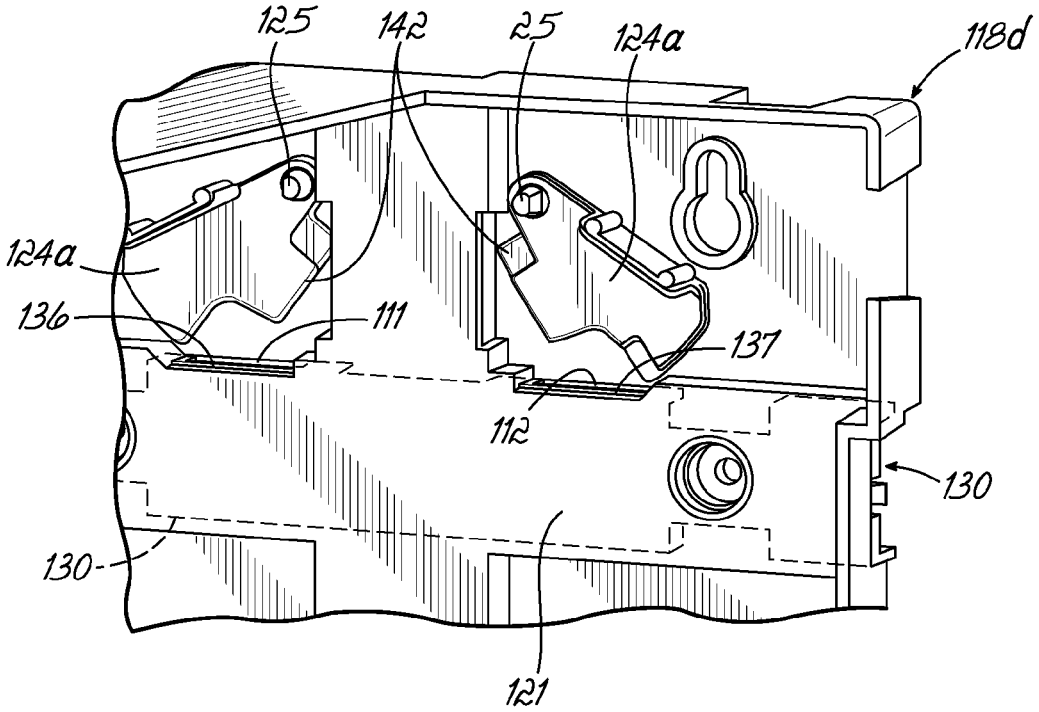
FIG. 7B is an isometric internal view of a rear cabinet wall and two disengaged locks with a rail component shown in dashed, hidden lines.
Figure 7C:
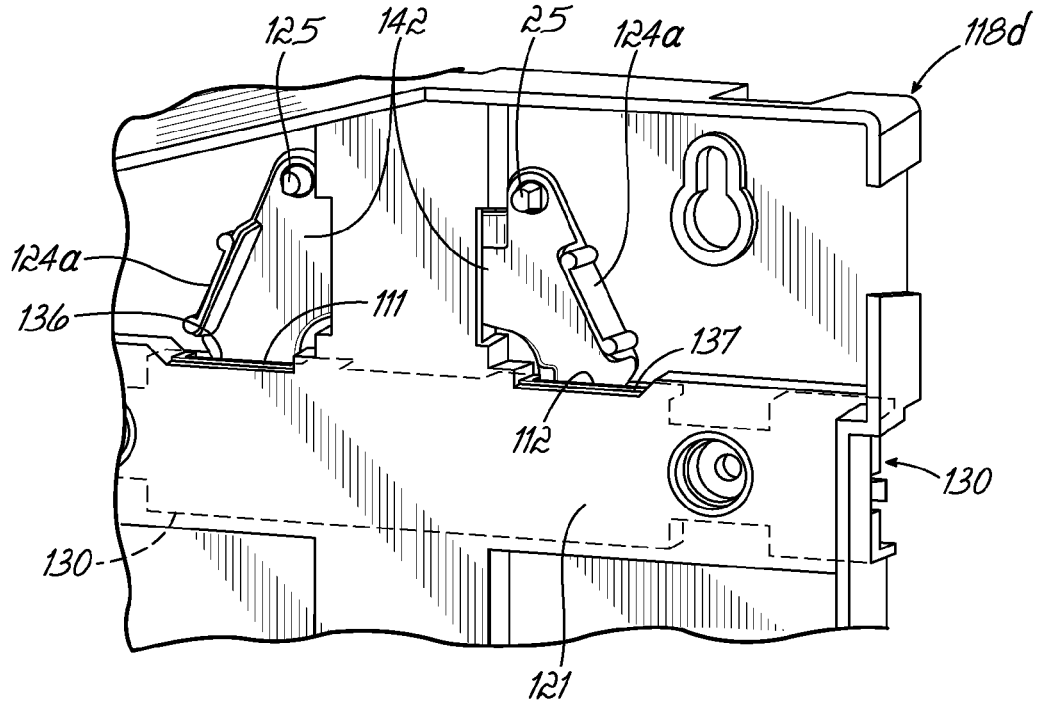
FIG. 7C is an isometric view similar to FIG. 7B but showing the locks engaged behind the rail.

FIG. 7A illustrates mounting a dispenser module 118*c* with a to-be-mounted chemical cabinet or module 118*d* on respective mounting rails 110. Two mounting locks 124 are shown in disengaged position in module 118*d*. These are disposed to turn downwardly into notches 111, 112 in a mounting rail 110 to secure module 118*d* to rail 110, and through access holes 136, 137 in channel 120 (FIGS. 7A and 8). (Rail 110*a* is referred to at 130 in FIGS. 7A-7, and 8.)

FIGS. 2-4 and 7B-7D illustrate disengaged and engaged mount locks 124 in more detail, When engaged, a lock 124, 124A of each module extends into the respective lock notch 111, 112 or 111*a*, 112*a* of a rail 110, and behind the rail as shown in these FIGS. This interferes with the rear surface of the rail, preventing the cabinet from being pulled outwardly away from the rail. When the module door is locked, access to the cabinet interior as well as locks 124 is secured and neither the cabinet modules 118, 118*a*, nor the interior contents can be removed.

Figure 7D:
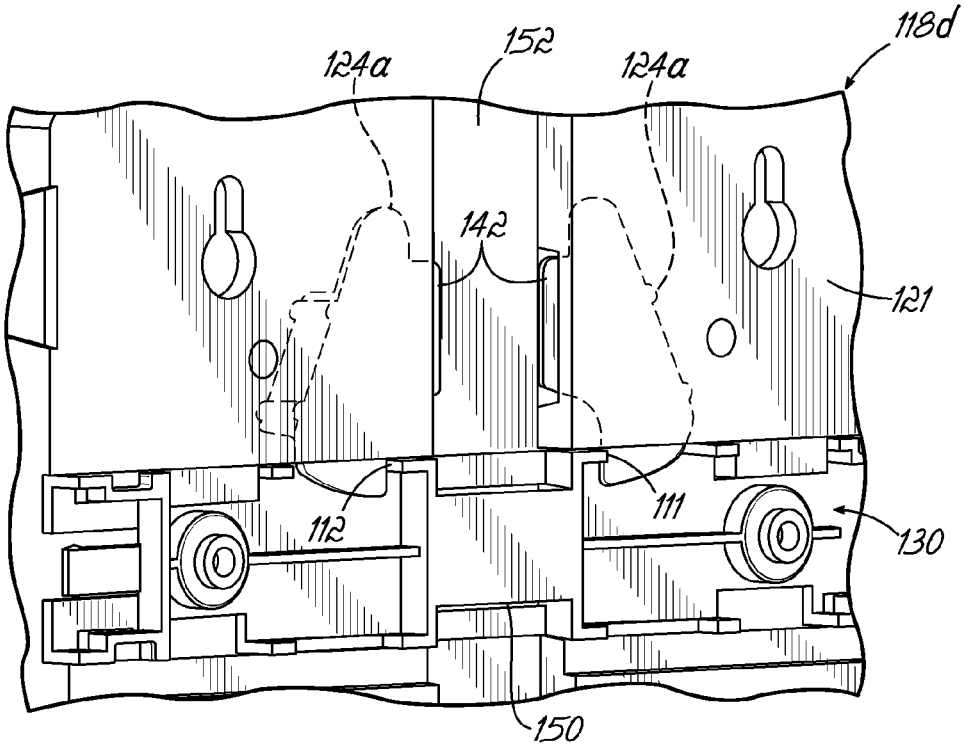
FIG. 7D is an isometric view of the subject of FIG. 7C, but taken from the "wall side" or rear of the rail and engaged locks, positions shown in dashed, hidden lines.
Figure 8:
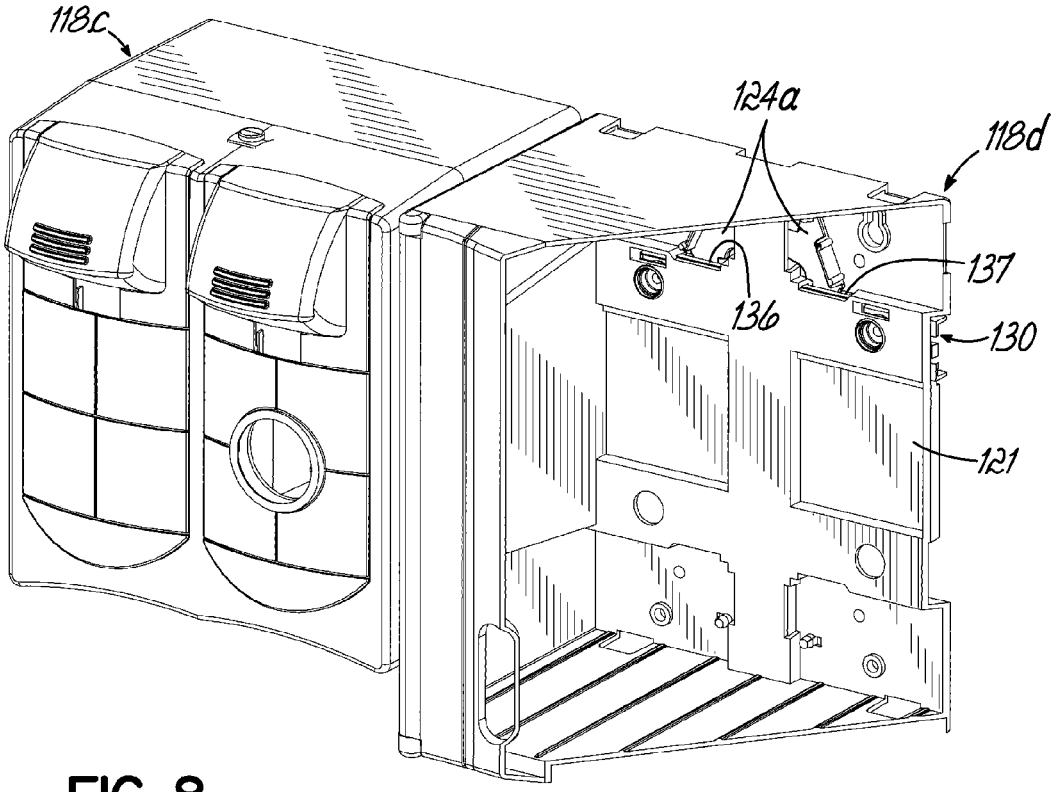

FIG. 7D illustrates the cooperation of module, lock and rail from the perspective of the wall side.

Also note the rotatable locks have tabs 142 (FIG. 4) for engaging behind lock notches 154, 156, 158, 160 (FIG. 8) in a vertical spacer 146 (FIG. 9A), where that is used, to further lock a modular cabinet, as will be described. For purposes of all FIGS., it will be appreciated that but for slightly different spacing, the lock structures and functions are similar for all modules and rails.

Turning now to FIGS. 9A-15D, a variety of but a few grid and module orientations contemplated by the invention are respectively illustrated.

Figure 9A:
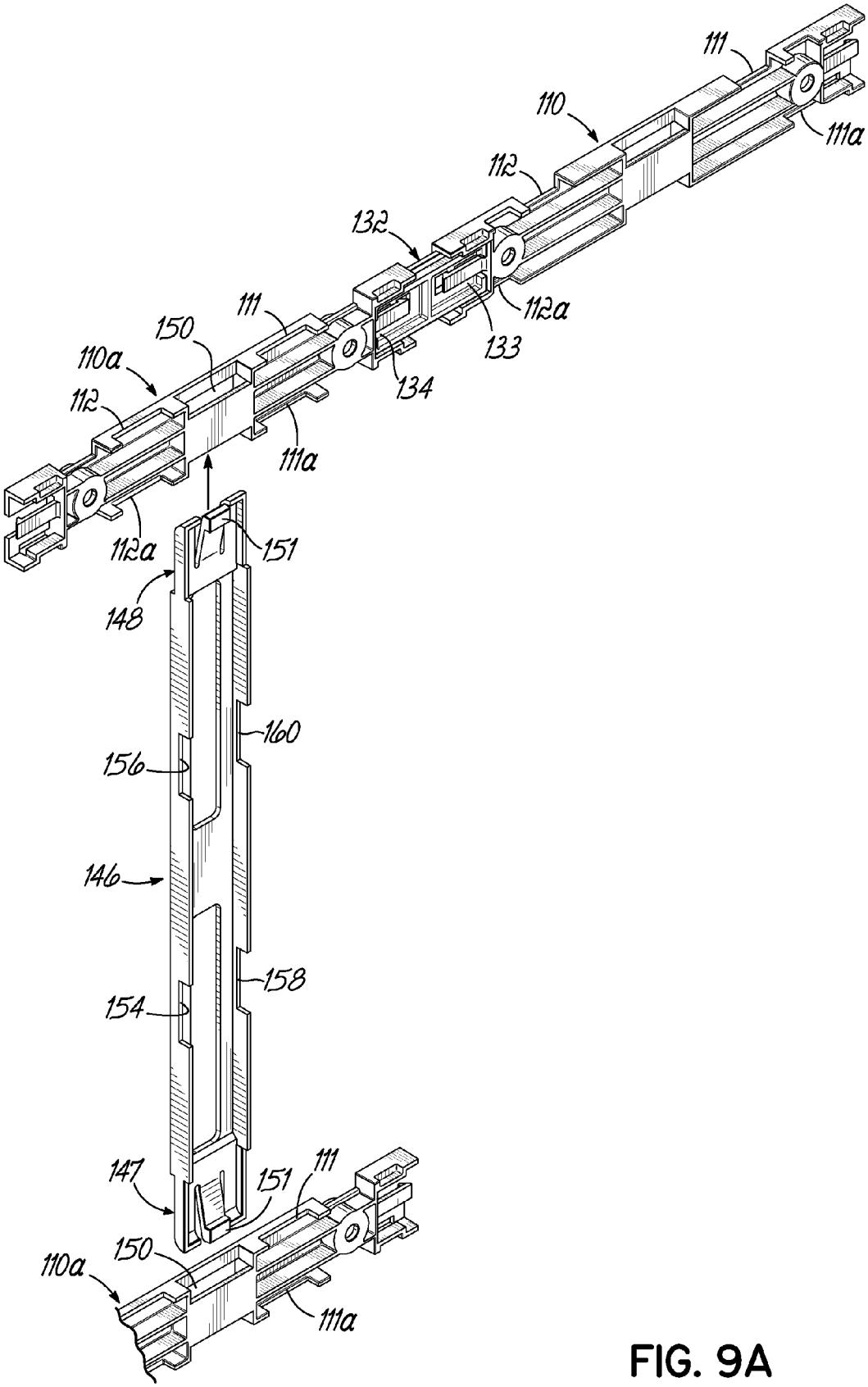
FIG. 9A is an isometric exploded view of but one configuration of a plurality of a composite horizontal rail, together with vertical spacers and connectors.
Figure 9B:
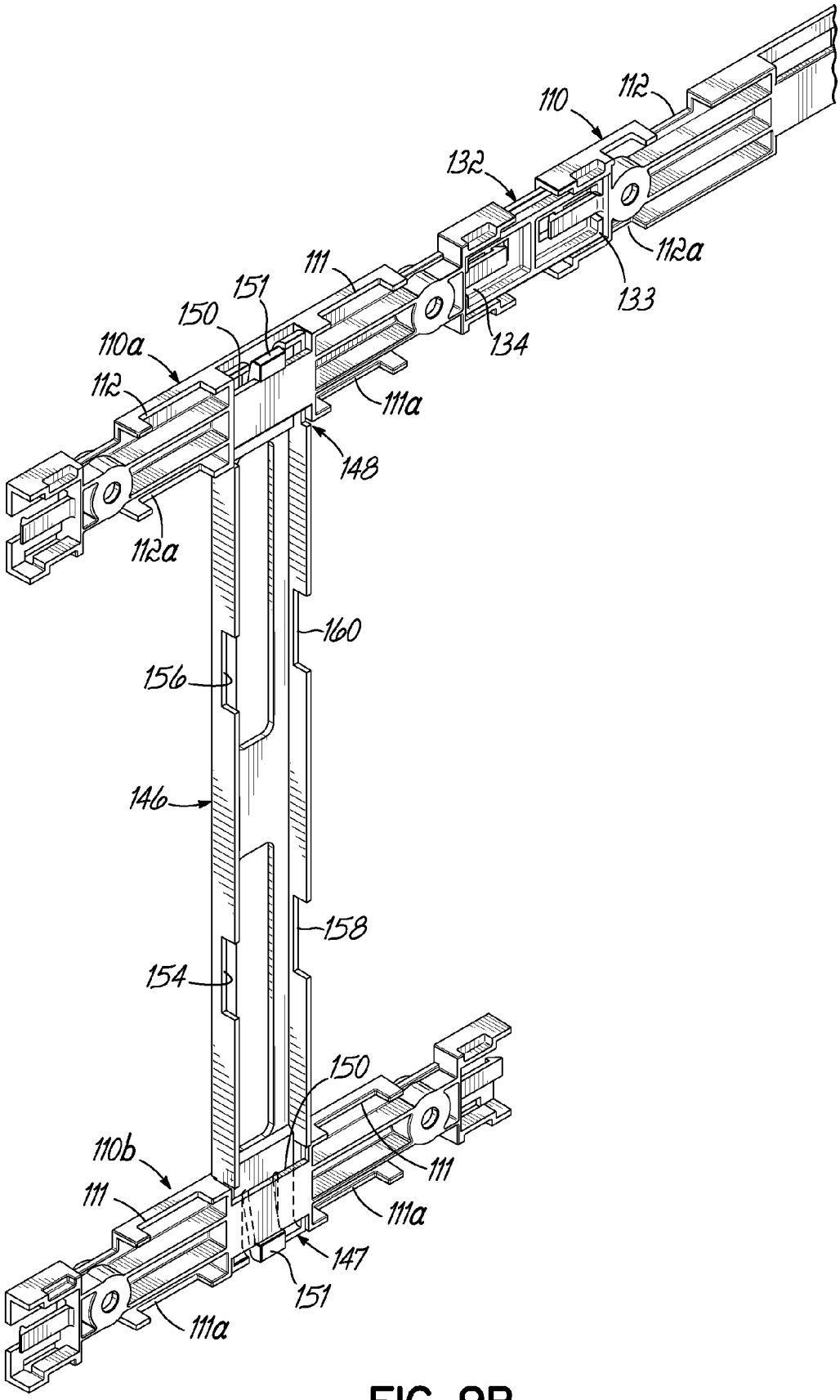
FIG. 9B is an isometric view of a vertical spacer as in FIG. 9A, from its rear or wall side, combined with an upper composite horizontal rail and a lower rail.
Figure 9C:
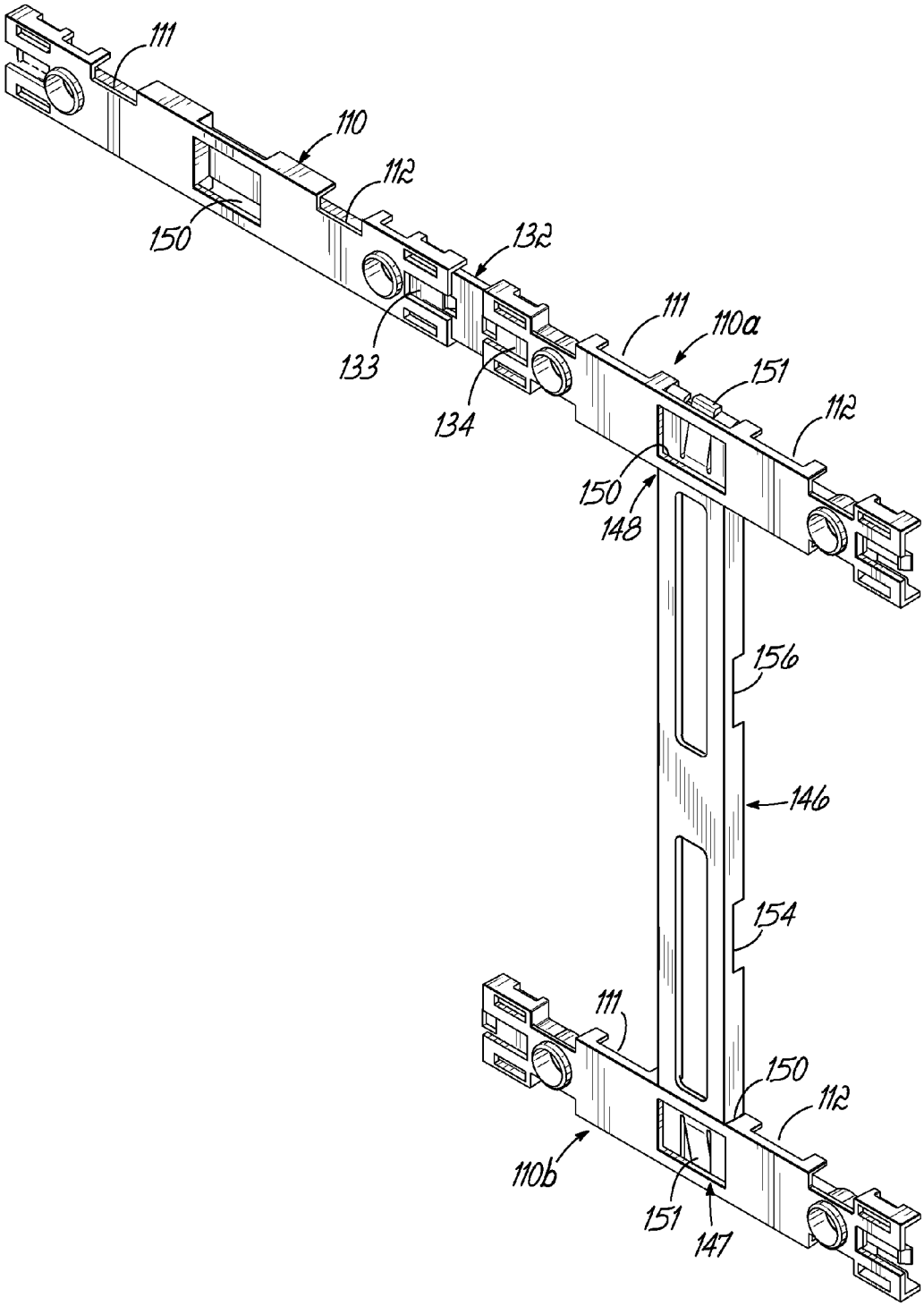
FIG. 9C is an isometric view of the front side (cabinet side) of the vertical spacer of FIG. 9B but in an alternate configuration.

In FIG. 9A, a dispenser mounting rail 110 is horizontally joined to a chemical cabinet mounting rail 110*a* as in FIG. 6. A further, lower, chemical cabinet mounting rail 110*a* is spaced below these by means of a vertical connector 146. Rail 110*a* is identical to other rails 110*a*. Similar lower rails 110*b* are also shown in FIGS. 9B and 9C, where the connector 146 is alternately connected to rail 110. The vertical connector 146 (spacer) has universal ends 147, 148, snappable with resilient lugs 151 engaging into receiving structure or receptacle 150 in the respective cabinet rails 110, 110*a*, 110*b* and so on. The length of vertical connectors 146 is predetermined so that chemical source cabinets can be vertically oriented in combination, the cabinets essentially one atop another. It will be appreciated the cabinets contain a vertical channel 152 (FIGS. 7D and 12B) for receiving the vertical spacers 146 where those are used.

Figure 10:
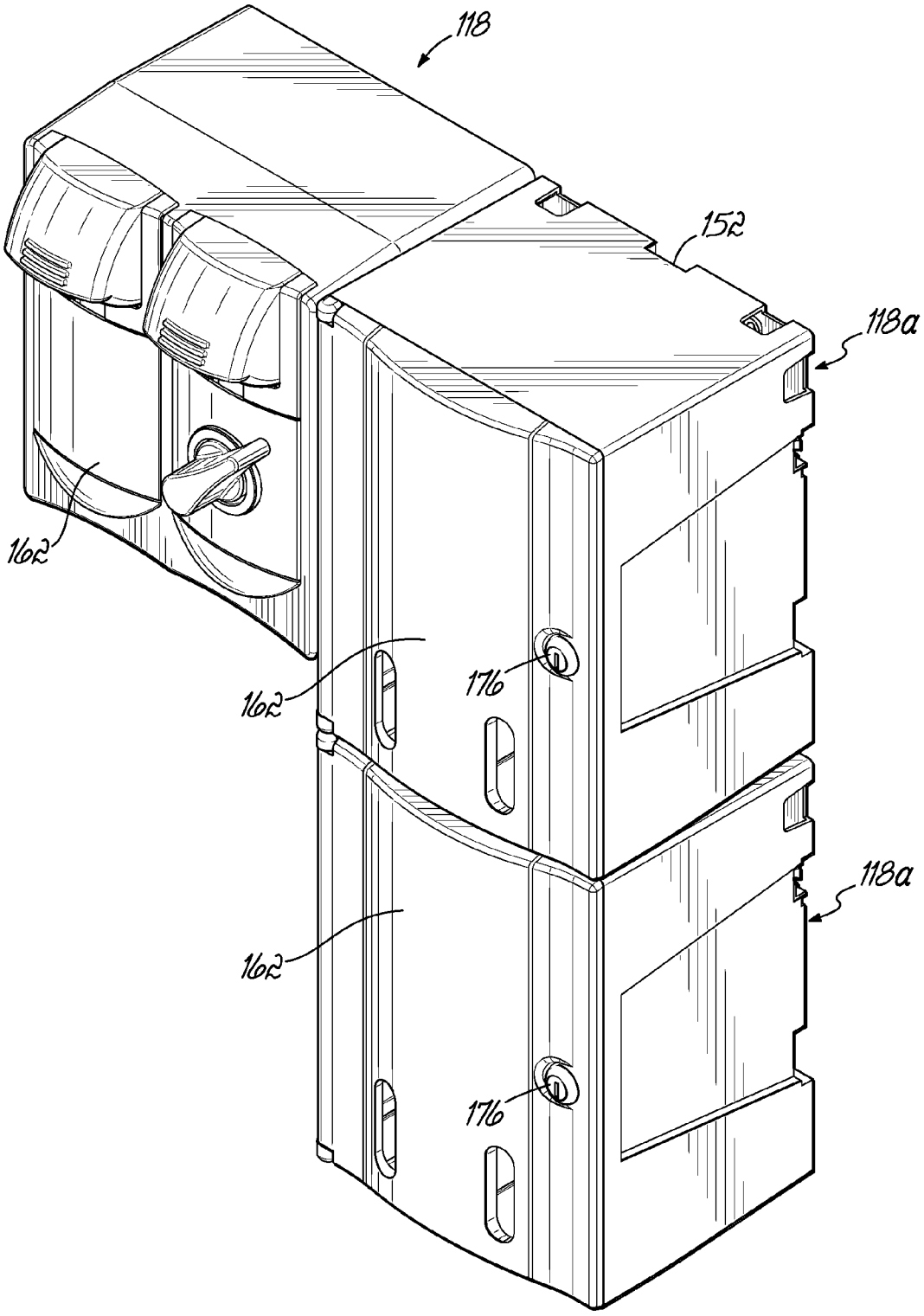

FIG. 10 illustrates a dispenser cabinet and chemical source cabinets configured for mounting by the rail grid of FIG. 9C The vertical connector 146 has lock notches, such as at 154, 156 (FIG. 8) for accepting the tabs 142 of the rotatable locks 124 described above, as well as opposed lock notches 158, 160 (FIG. 9A). The lower chemical cabinet mounting rail 110*b* is identical to the rail 110*a* above it, as shown in FIGS. 9B, 9C.

It will be appreciated the length of vertical connectors 146 is coordinated with the height of modules to be mounted thereon, such that horizontal rails 110, 110*a* and 110*b* are positioned in parallel, and to cooperate with the horizontal channels 120 in the respective modules.

FIG. 10 illustrates dispensing 118 and chemical 118*a* cabinets respectively mounted on the grid shown in FIG. 9C. The cabinets or modules 118 have pivoted, snap-on doors 162. Modules 118*a* have lockable doors 164 preventing unauthorized access to their contents and removal of the chemicals.

Figure 11:
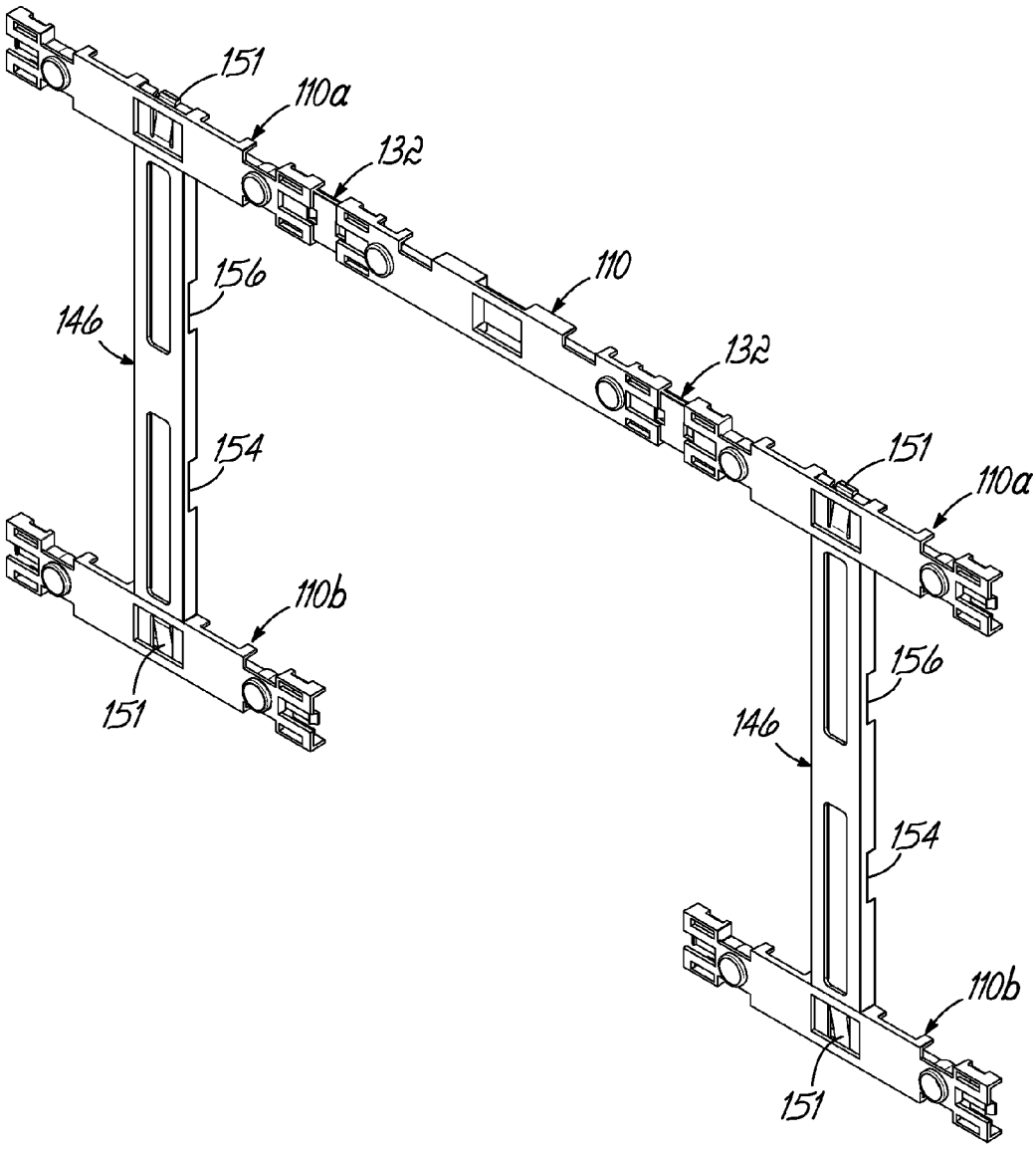
Figure 12A:
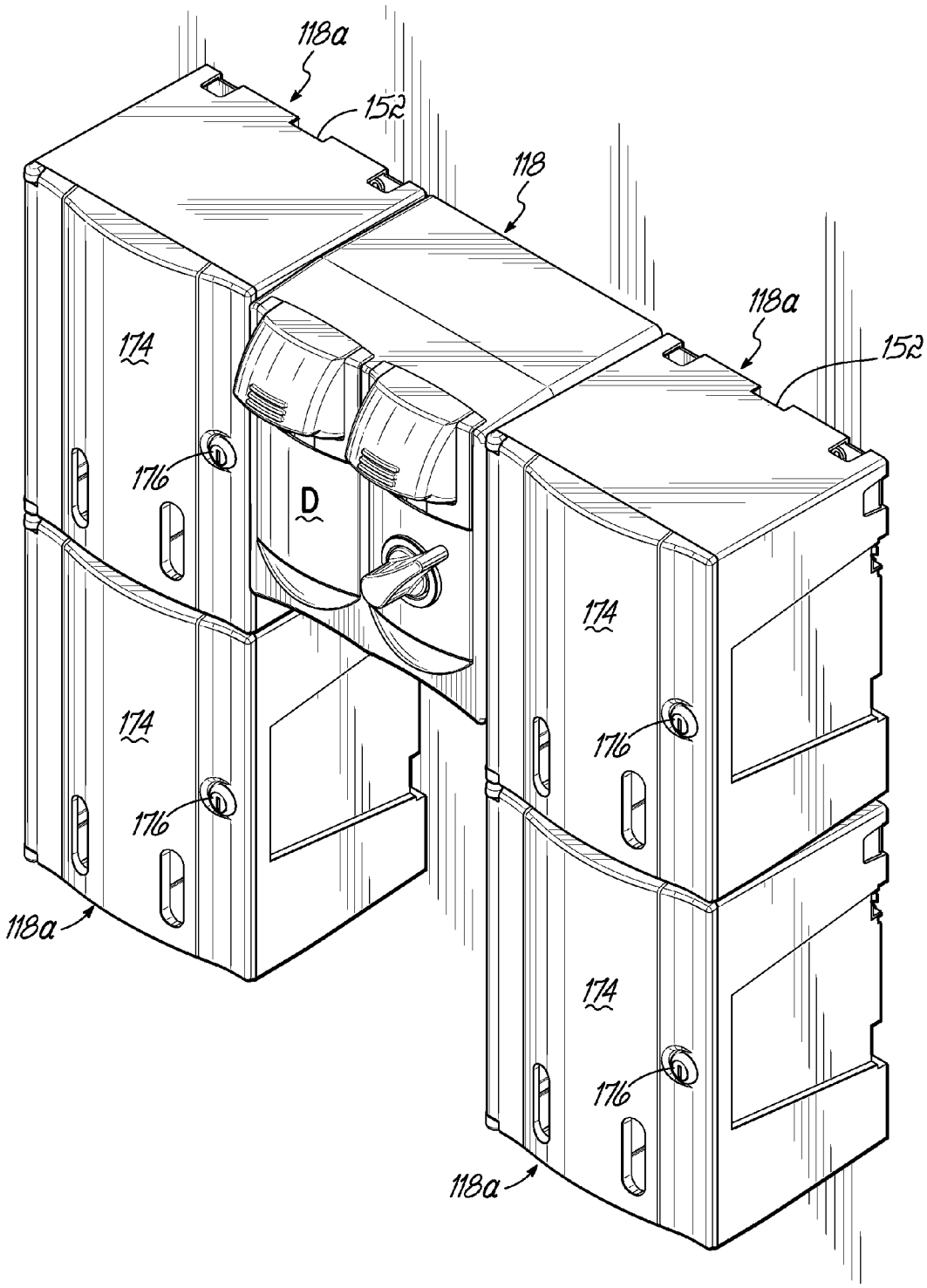
FIG. 12A is an isometric view of a dispenser assembly and concentrated chemical cabinets as would be mounted on the rail grid of FIG. 11.

FIGS. 11 and 12A illustrate another of the variety of mounting rail grids, connectors and cabinets or modules having same construction as noted above, but in a different respective configuration to illustrate the adaptability of the mounting grid components and modules to fit a variety of spatial circumstances. These are but one of many available configurations as will be appreciated.

Figure 12B:
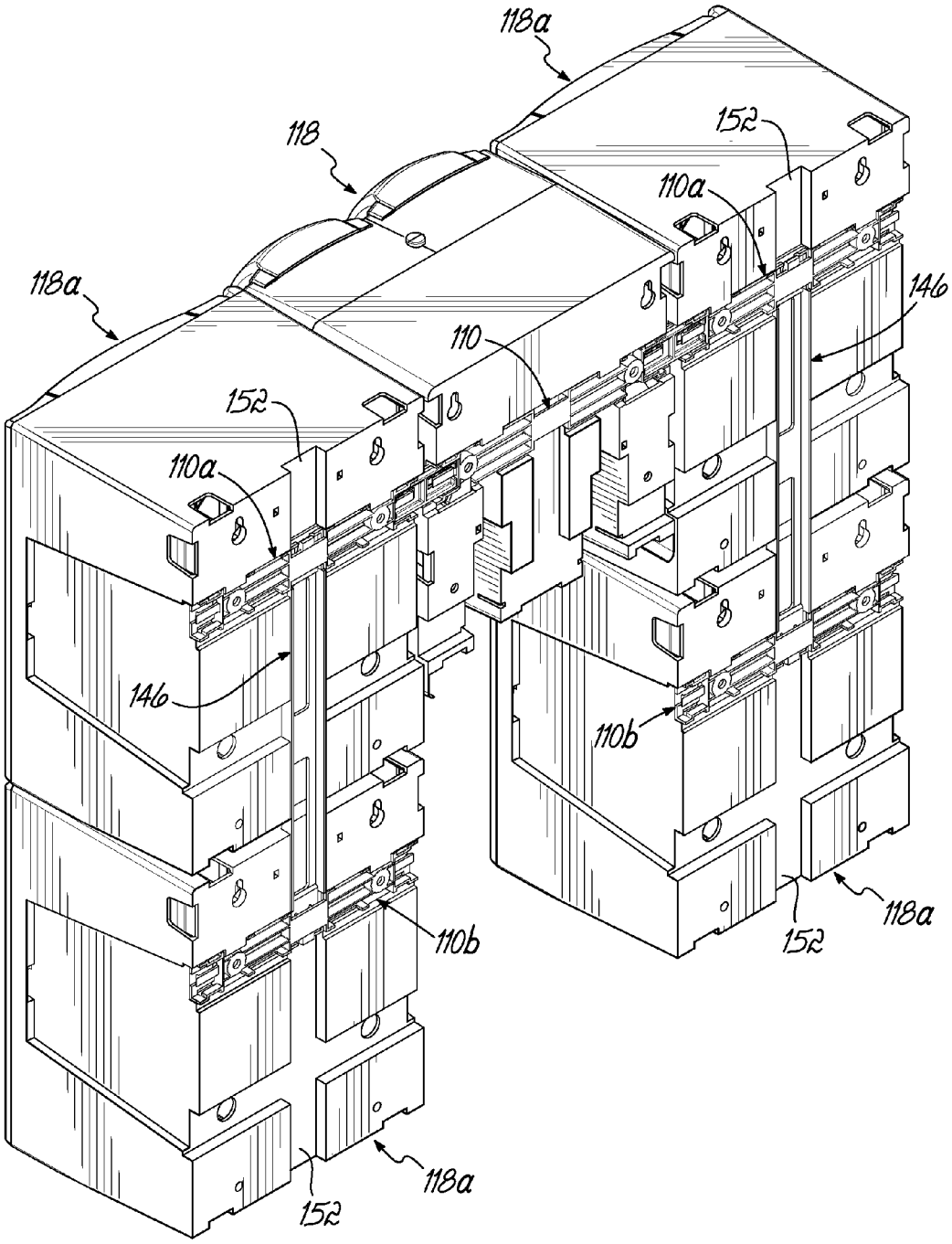
FIG. 12B is an isometric rear view of the mounted dispenser assembly and chemical cabinets of FIG. 12A.

In FIGS. 11 and 12A, a dispenser module 118 is mounted on a rail 110. Two first chemical source modules 118*a* are respectively mounted on either side of dispenser 118 on rails 110*a*. Two further second chemical source modules 118*a* are mounted respectively beneath the first chemical modules 118*a* on lower rails 110*b*. Each lower rail 110*b* is mounted beneath a parallel rail 110*a* thereabove, and spaced therefrom by a vertical connector 146. The two upper rails 110*a* are connected to center rail 110 via horizontal connectors 132 for spacing. FIG. 12B shows a rear view of the module configuration of FIG. 12A.

It will be appreciated that dispenser module 118 has one or more snap-on doors "D" as shown and as will be described. Modules 118*a* have doors 174 (like doors 162 of FIG. 10) provided with respective locks 176. Rotatable rail locks 124 in each module are accessible only by way of access to the modules 118, 118*a* through lockable doors 174, or door D (FIG. 12A).

From these FIGS., it will be appreciated that a variety of cabinet configurations can be provided. The installer applies a mounting grid of rails to a wall or other surface using the rails and connectors to define the "footprint" of the desired system. These components are easily applied to the wall and automatically space or define the final cabinet or module positions. Thereafter the cabinets or modules are secured to the rails (and any relevant vertical connectors) in desired orientation by perpendicular, transverse movement onto the rails and then by locks 124. The system is thus configured for a large variety of available mounting spaces.

Figure 13A:
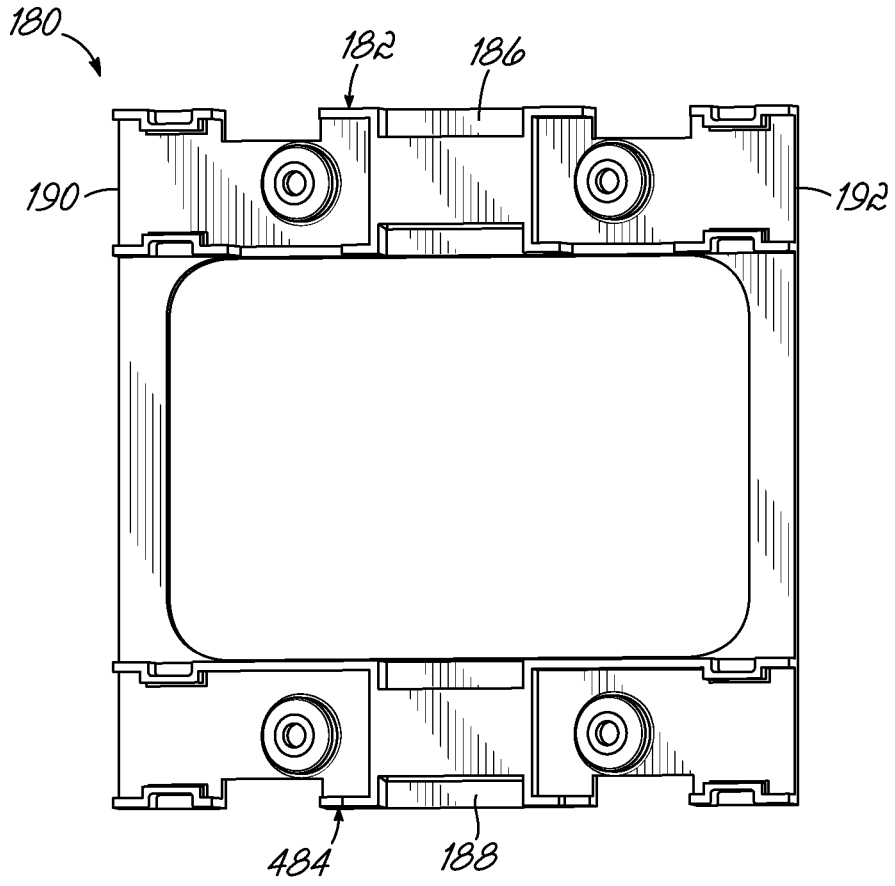
FIG. 13A is an elevational rear view of a mounting rail frame for use with a single button dispenser as in FIG. 12B.
Figure 13B:
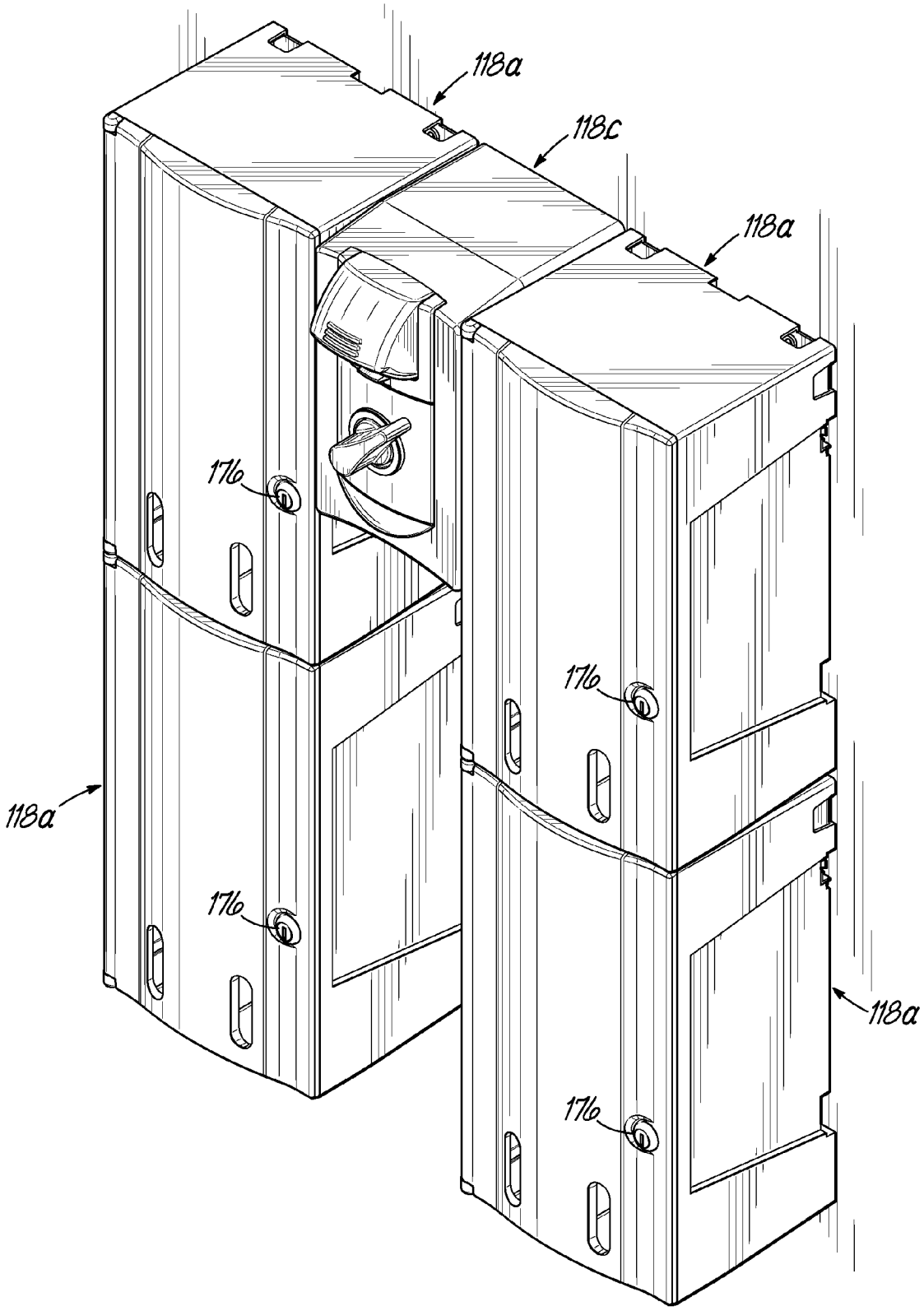
FIG. 13B is an isometric view of a single dispenser, one-button dispenser assembly and associated cabinets as in FIG. 12B.
Figure 14C:
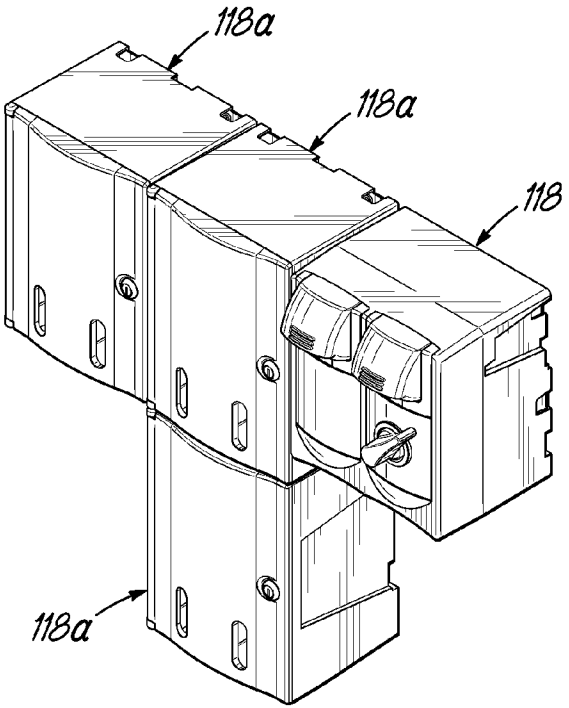
FIGS. 14A-14E are isometric views of but a few of the cabinet or dispenser module orientations of the invention, illustrating a variety of mounting configurations and module orientations, rendered possible by the configurable rail mounts of the invention.
Figure 14B:
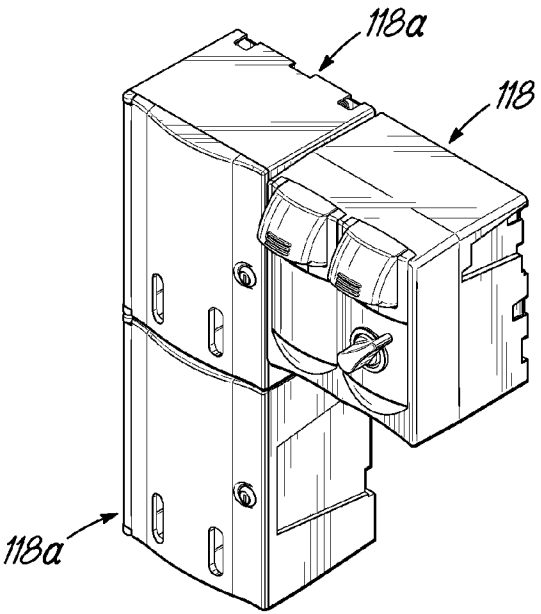
Figure 14A:
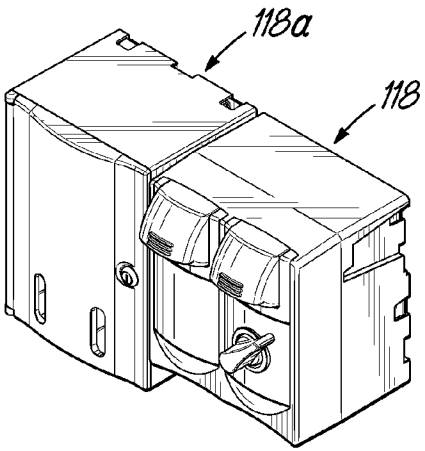
Figure 14E:
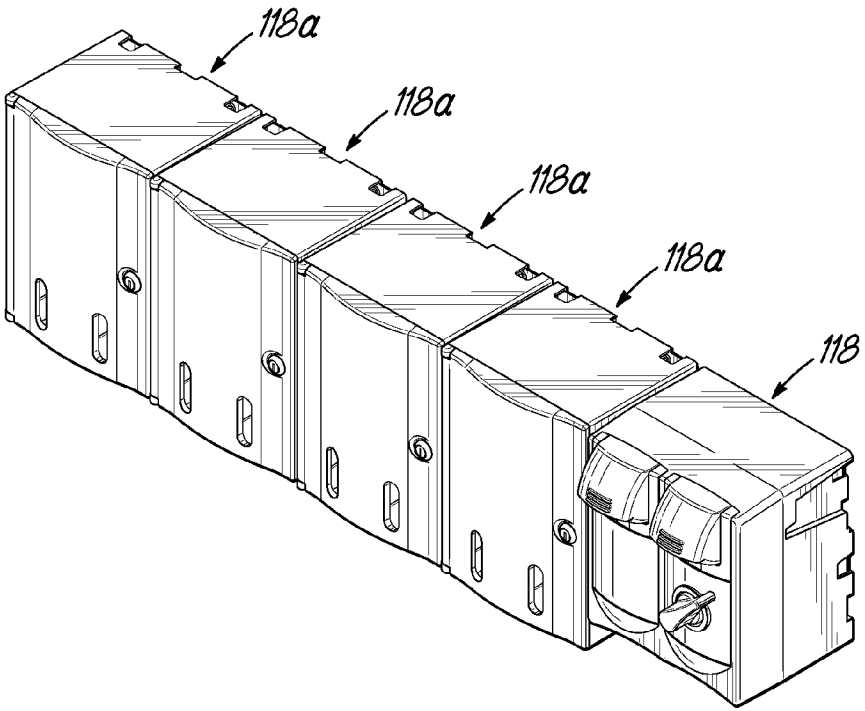
Figure 14D:
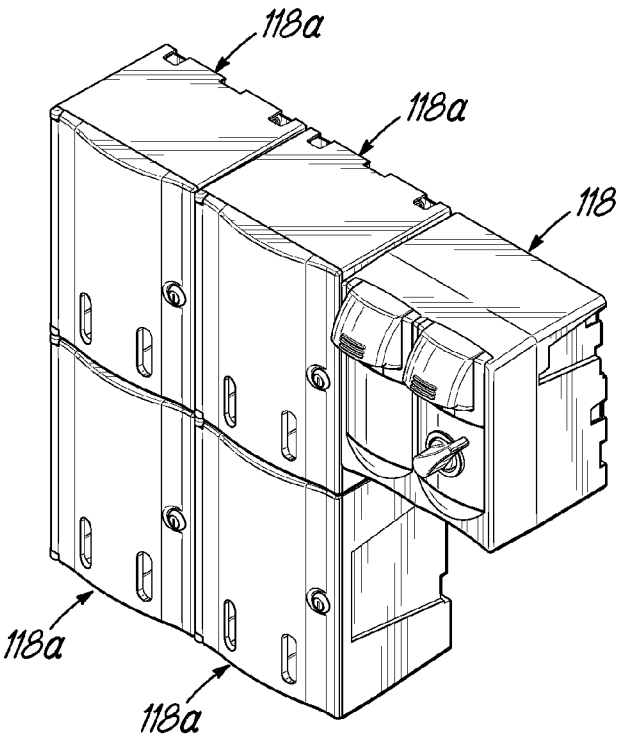
Figure 15B:
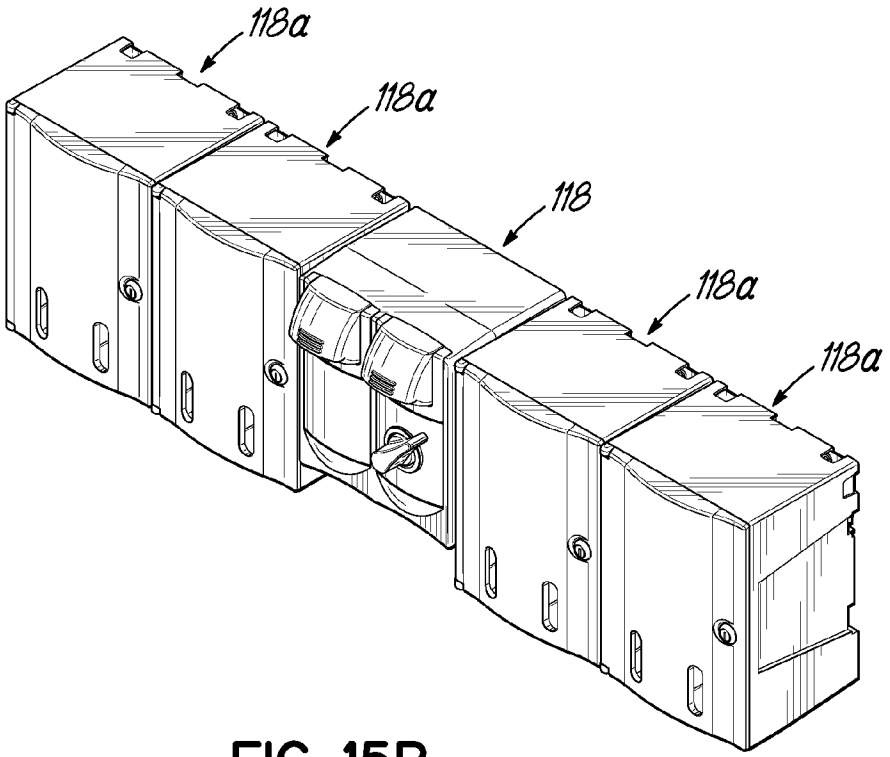
Figure 15A:
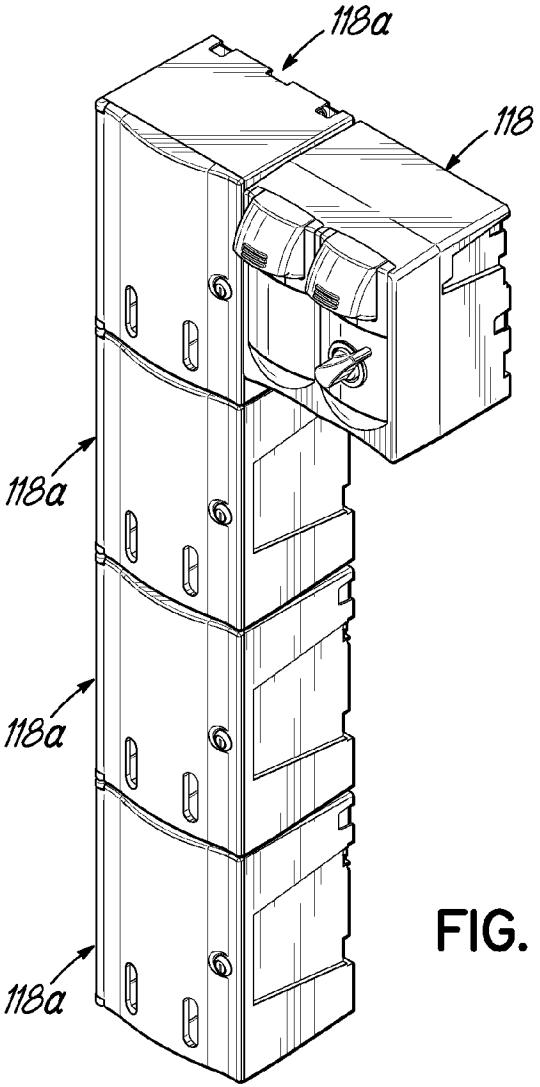
Figure 15C:
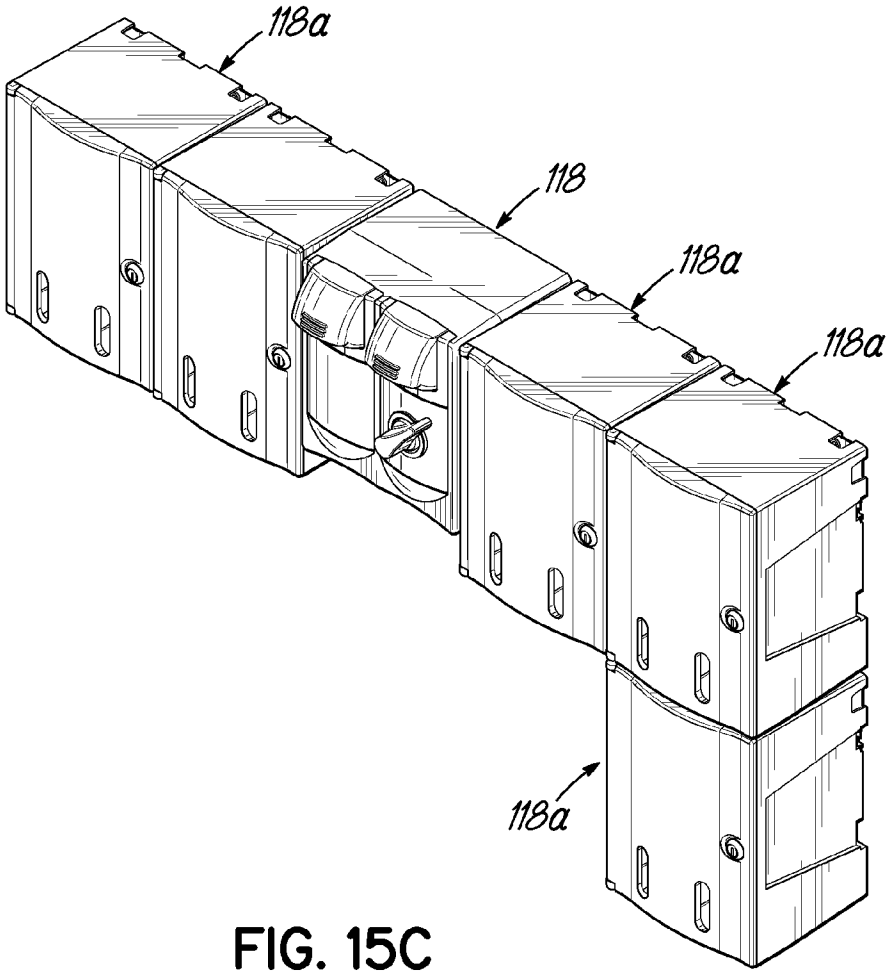
Figure 15D:
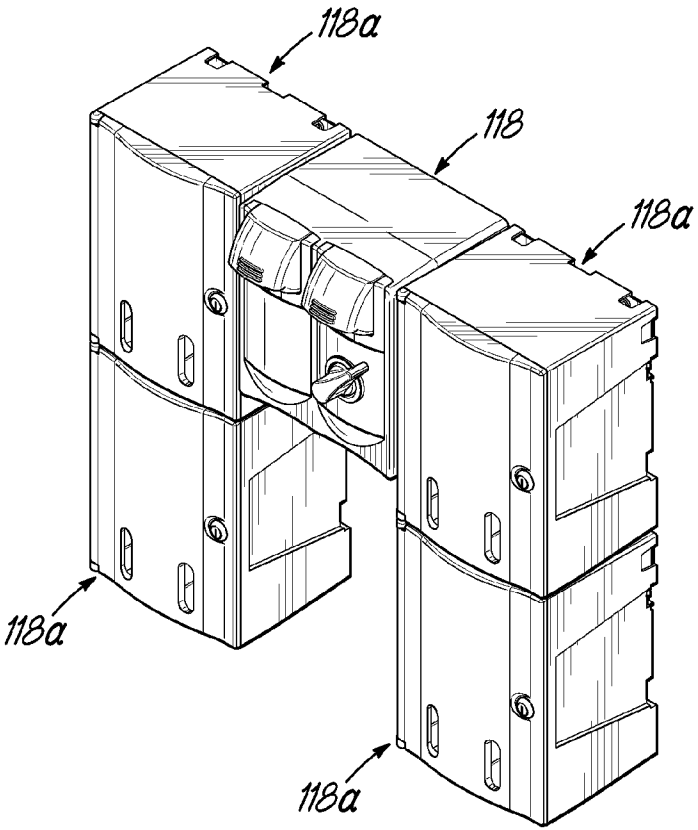
Figure 16:
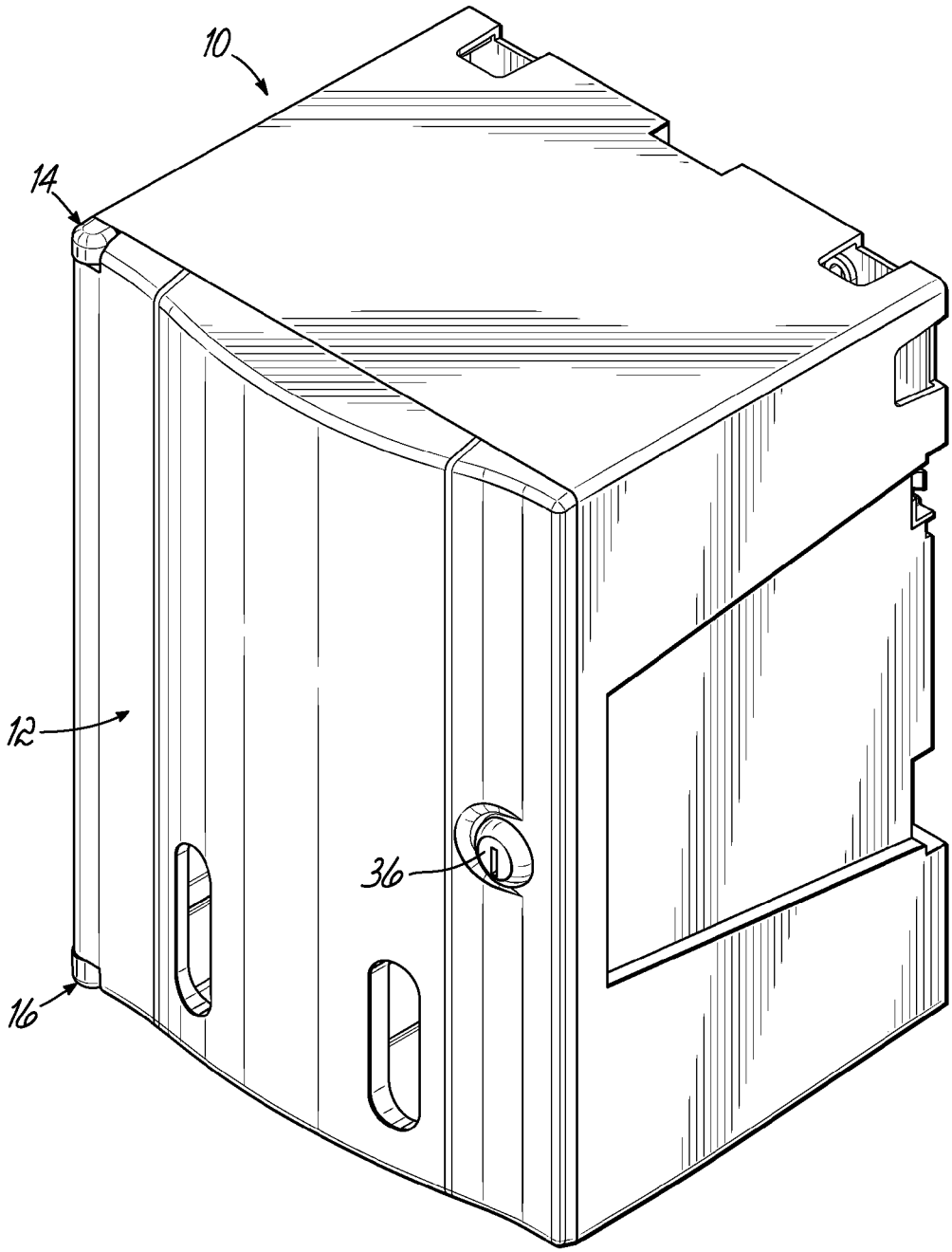
Figure 17:
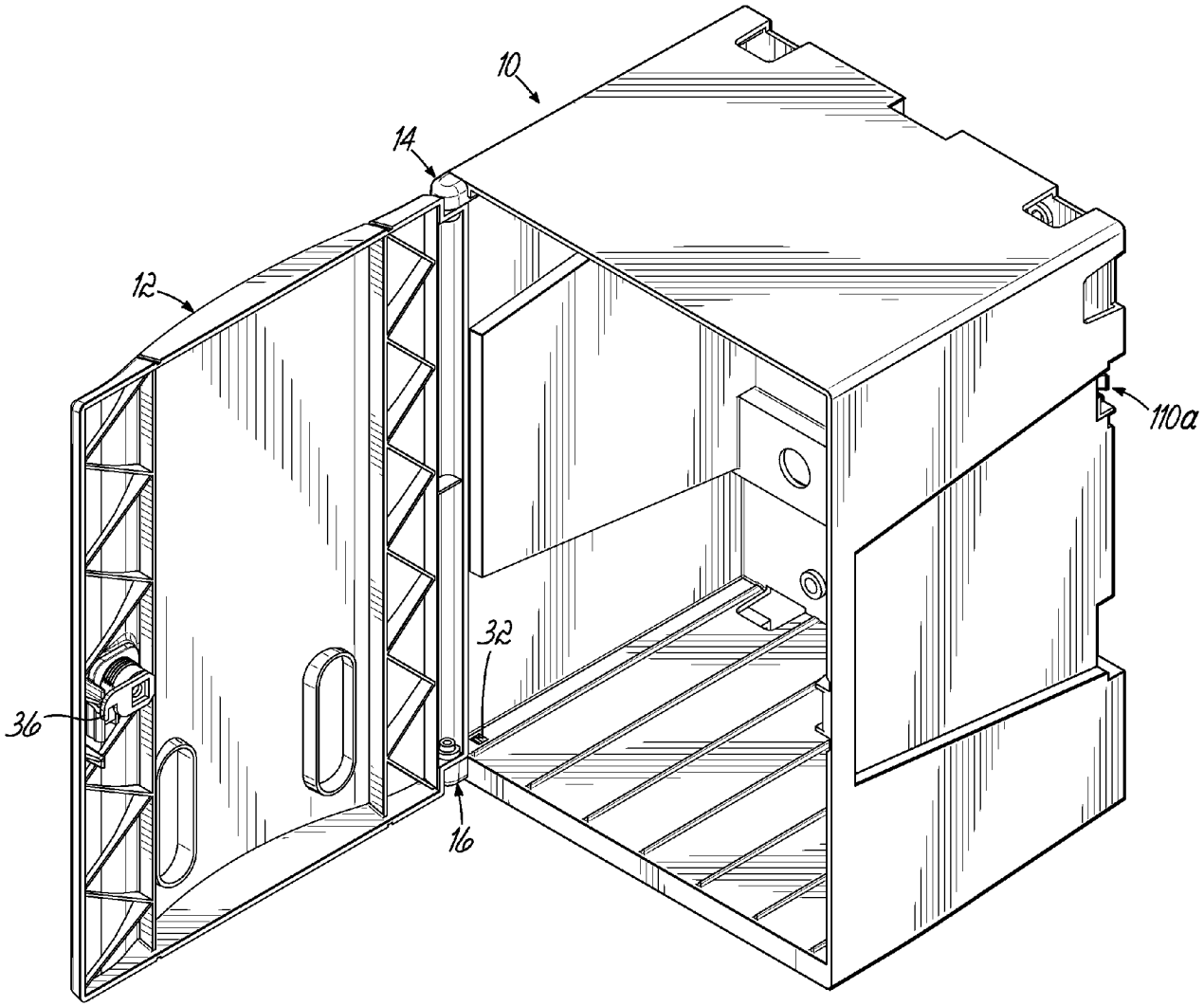
Figure 18:
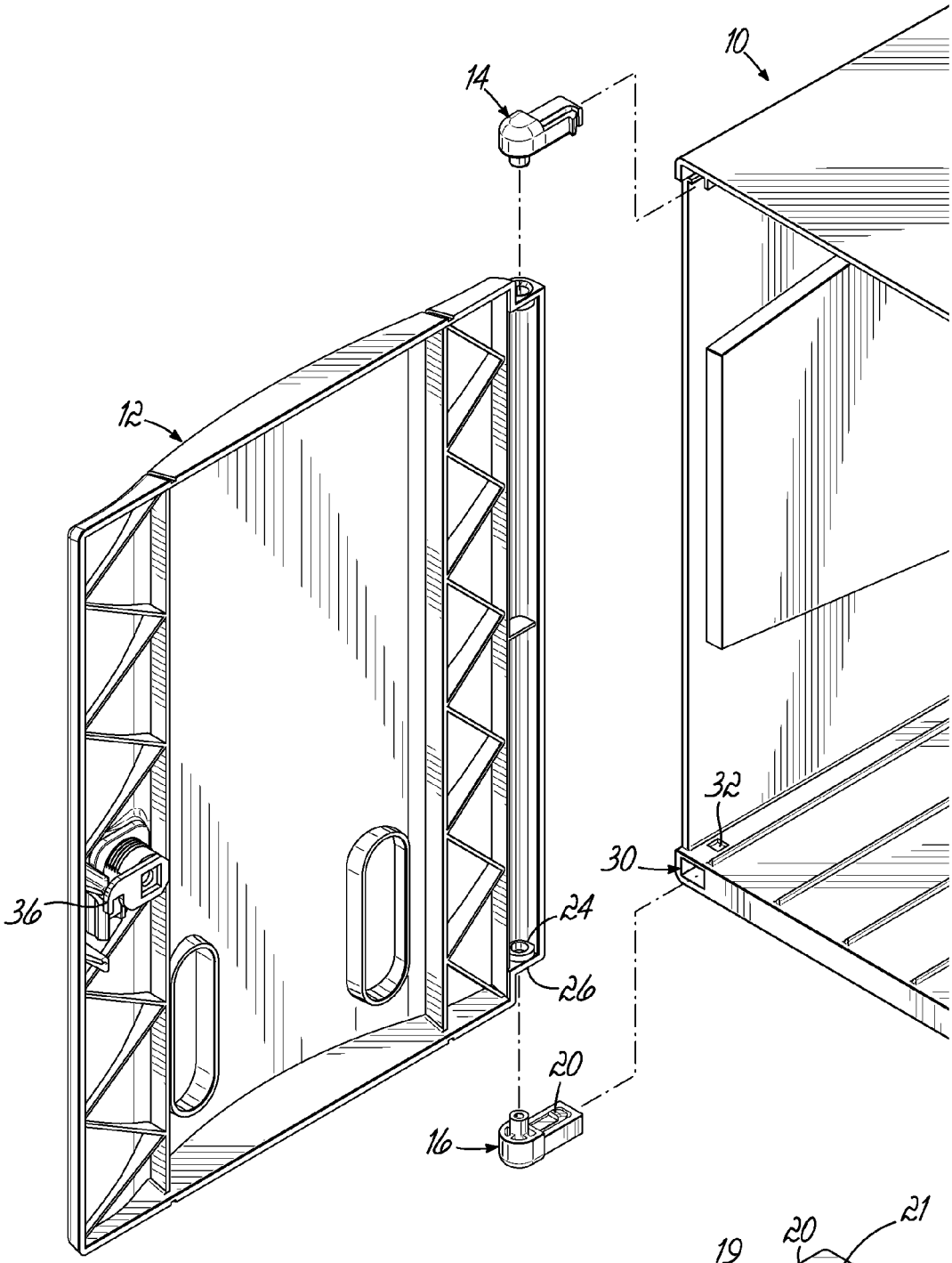
Figure 19:
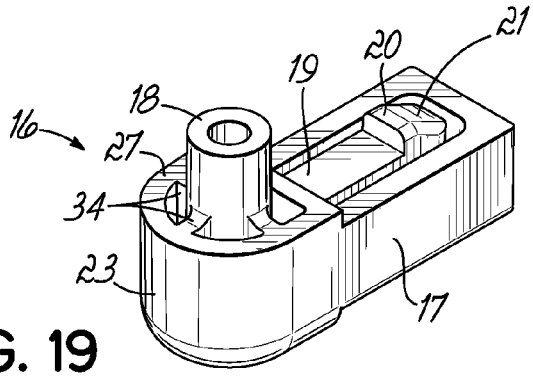
Figure 20:
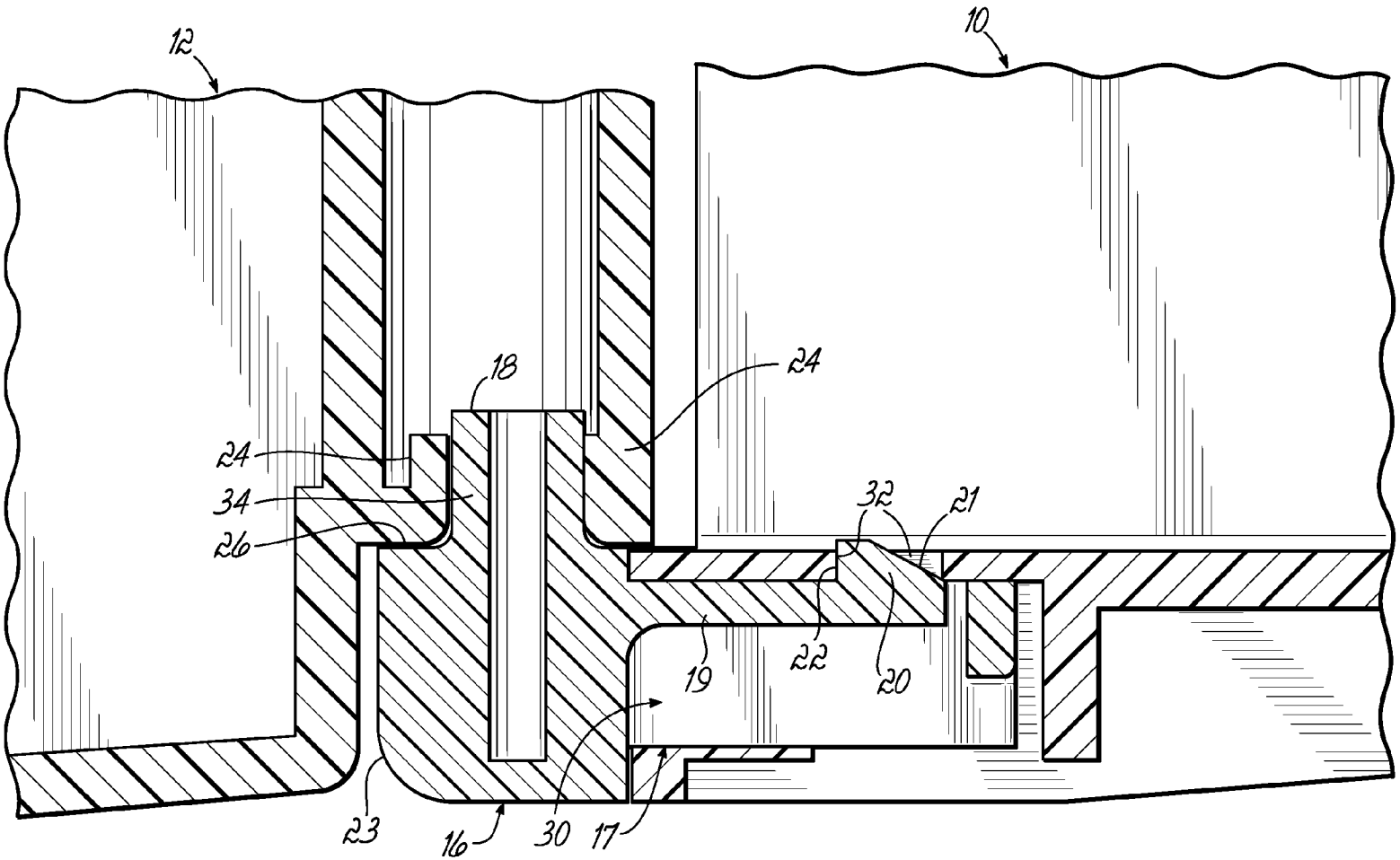

In FIGS. 13A and 13B, there is disclosed a modular dispensing mounting system according to the invention wherein a single button dispenser 118*c* is used. Instead of a single horizontal mounting rail 110, a one-button dispenser mounting rail frame 180 (FIG. 13A) is used. Such frame 180 is easily incorporated into the single rail grid of the foregoing embodiments and is incorporated in the term "mounting rail".

With attention to FIG. 13A, rail frame 180 includes upper and lower frame components 182, 184, each with a single locking notch 186, 188 for a respective lock member 124 (not shown) mounted in a dispenser module 118*c*.

At least upper component 182 has opposite ends 190, 192 configured to accept horizontal connectors 132 (not shown) as desired. Lower component 84 has similar structural and functional ends.

Such a rail frame 180 is used as in FIGS. 13A, 13B in cooperative grid with rails 110, 110*a* (not shown) on either side of upper component 182 (and connectors 132). Rails 110*a* are connected to respective lower rails 110*b* through respective vertical connectors 146 as in FIG. 9C.

Accordingly, a single button dispenser is mounted between two upper chemical source modules 118*a*, which are mounted above two respective further chemical source modules 118*a* as in FIG. 13B.

Other configurations of modules, without limitations, are illustrated in FIGS. 14A-15D. Many other available configuration installations will be appreciated.

It will be appreciated that the rail grid components can be combined in a large variety of configurations to securely mount modules, such as dispenser and chemical source modules 118, 118*a*, 118*c*, 118*d* in a wide variety of positions to accommodate a wide variety of available footprint or wall space.

Moreover, it will be appreciated that each module preferably includes structure such as channels 120, 152 to receive the respective horizontal rails or frame members 110, 110*a*, 110*b* and 180 and vertical spacers 146. Also, one or more locks 124 disposed within the modules can be operated to secure the respective modules to the rails (and the support wall) by rotation through such channels to engage the rails through the locking notches therein, whether the locks are oriented in the module above or below channels 120.

In the same fashion, the modules 118, 118*a*, 118*c* may include vertical channels 152 to receive portions of the vertical spacers or connectors 146 when the configuration desired requires it. Lock tabs 142 can be rotated into locking notches in the vertical rails as well to likewise secure the modules thereto.

It will also be appreciated that accommodations in the modules can be made in any suitable way, such as access openings, to accommodate tubes, conduits, hoses or the like between the dispenser modules 118, 118*c* and the chemical source modules 118*a* to provide chemical flow therebetween.

As a result, system mounting is greatly simplified and one grid and cabinet system is used to fit a large variety of applications, both with respect to available mounting space and to required system parameters such as multiple chemical sources. The invention provides a clean look and is customizable on site. Overall costs attending custom design and fabrication of parts are eliminated, and security is provided.

It will be appreciated herein that the terms "cabinet" and "module", when referring to the invention only, are used interchangeably herein.

Turning now to FIGS. 16-29B, additional features of the invention including the field replaceable hinge, the field serviceable manifold and bracket assembly, and the rotatable water inlet fitting are described in more detail.

Field Replaceable Hinge:

A chemical dispenser and/or chemical source module or cabinet 10 is shown in FIGS. 16, 17, 18, 20 and 22. A door 12 is pivoted to module 10 by top hinge 14 and bottom lower hinge 16. Lock 36 secures the door in a locked, closed position.

Top and bottom hinges 14, 16 are slightly different but both provide field replaceability. Aspects of each are shown in following respective FIGS.

Lower or bottom hinge 16 is best seen in FIGS. 17-20, The hinge 16 includes an elongated shank 17 and a pivot boss or post 18 extending at 90 degrees from the elongated shank 17. Shank 17 has a yieldable latch arm 19 with a lock lug 20 at a free end thereof. Lock lug 20 includes a sloped surface 21 and a latch or lock surface 22.

Hinge member 16 generally rectangularly-shaped sides as shown and an outer curved end 23.

Door 12 is mounted via a hinge post boss 18 received in a door buttress 24 (FIG. 20) defining a cylindrical passage 25 for receiving boss 18 with door 12 pivotable around an axis of boss 118. Door surface 26 slides on hinge surface 27 when the door is opened or closed.

Cabinet or module 10 is provided with a recess 30 for receiving shank 17 of hinge 16, Recess 30 has sufficient surfaces slidingly receiving shank 17 so that hinge 16 is supported in position therein as shown in the FIGS.

In use, the hinge 16 is slid into recess 30 and arm 19 is depressed by this motion until lock lug 20 snaps into aperture 32 (FIG. 17) extending from recess 30. Sloped surface 21 facilitates insertion of hinge 16 into recess 30. Hinge 16 is thus releasably secured in place and can be removed from recess 30 and module 10 by depressing lug 20 and withdrawing shank 17 when door 12 is opened.

Thus, hinge 16 can be easily removed from recess 30 of cabinet 10 by depressing lock lug 20 downwardly through aperture 32 until lock surface 22 clears aperture 32 and hinge 16 is drawn then outwardly for replacement. This, of course, requires the door 12 to be opened and, if locked, then unlocked prior to access to remove the hinges.

Finally, it will be noted that hinge 16 is manufactured in any suitable way, making it more frangible, or structurally weaker than either cabinet 10 or door 12. In this way, the hinge 16 will break or fatigue prior to cabinet 10 or door 12 and thus is more likely to fail first, before door or cabinet failure when the door is stressed. Should that occur, the hinge can be withdrawn from cabinet 10 and a new hinge inserted into buttress 24 of door 12. Thereafter, the door and hinge are laterally moved toward cabinet 10, hinge shank 17 in recess 30, until lug 20 snaps into aperture 32. Breakage is thus confined to a less expensive, easily field-replaceable hinge member 16, as opposed to door 12 or cabinet 10.

For assembly, upper hinge 14 and lower hinge 16 are preferably applied to door 12 and both hinges pushed into respective recesses in cabinet 10 concurrently.

The actual weakened features of hinge 16, for example, might be provided by a lightweight web member 34 mounting boss 16 to the hinge, by any other designed structural areas or lines of weakness or by weaker materials than those of door 12 or cabinet 10.

At the same time, it will be appreciated that door 12 can be locked by lock 36 of any suitable construction. Thus, access cannot be gained to the cabinet 10 unless the lock is operated and the hinge 16 (and door 12) cannot be removed without access to the interior of cabinet 10 since lock lug 20 can only be accessed from the interior.

Figure 21:
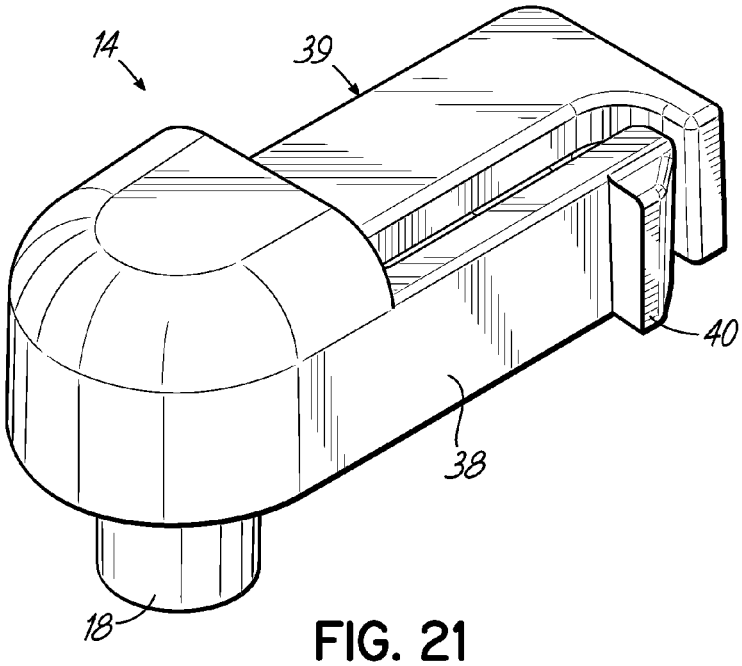
Figure 22:
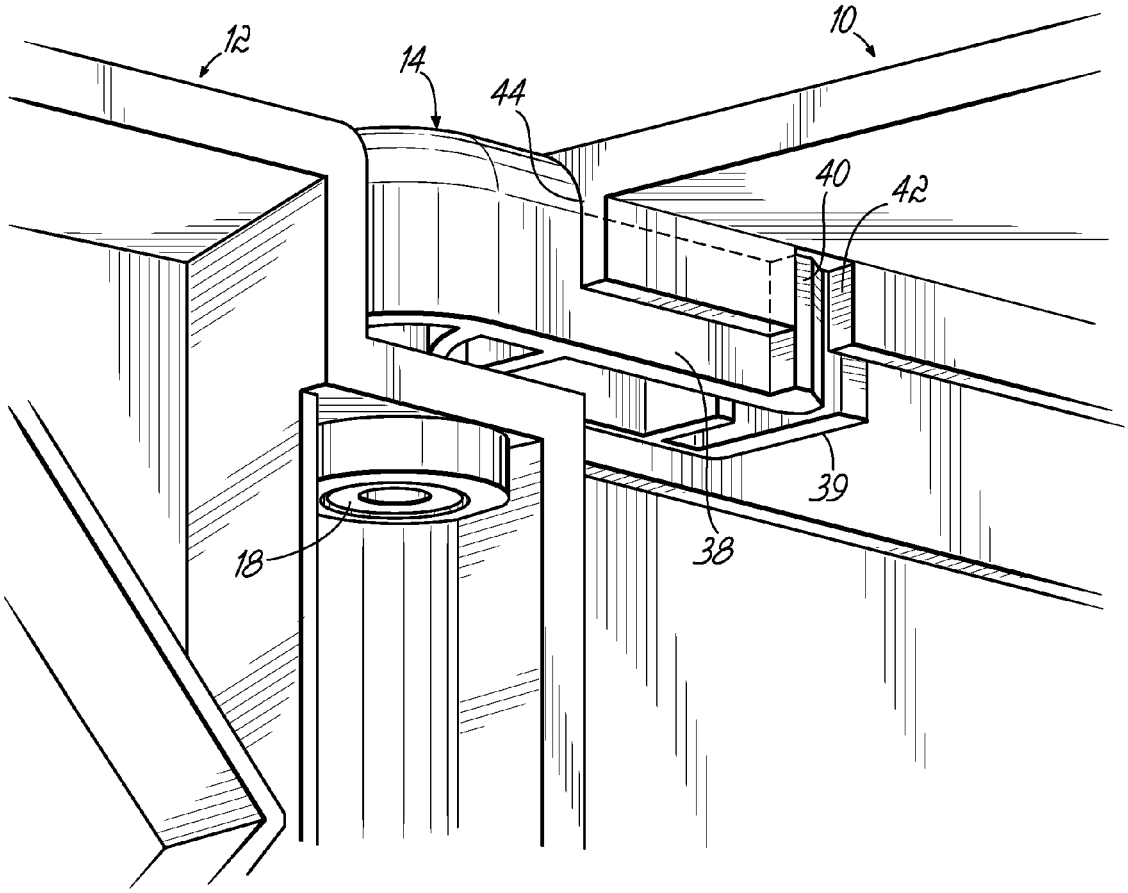
Figure 23:
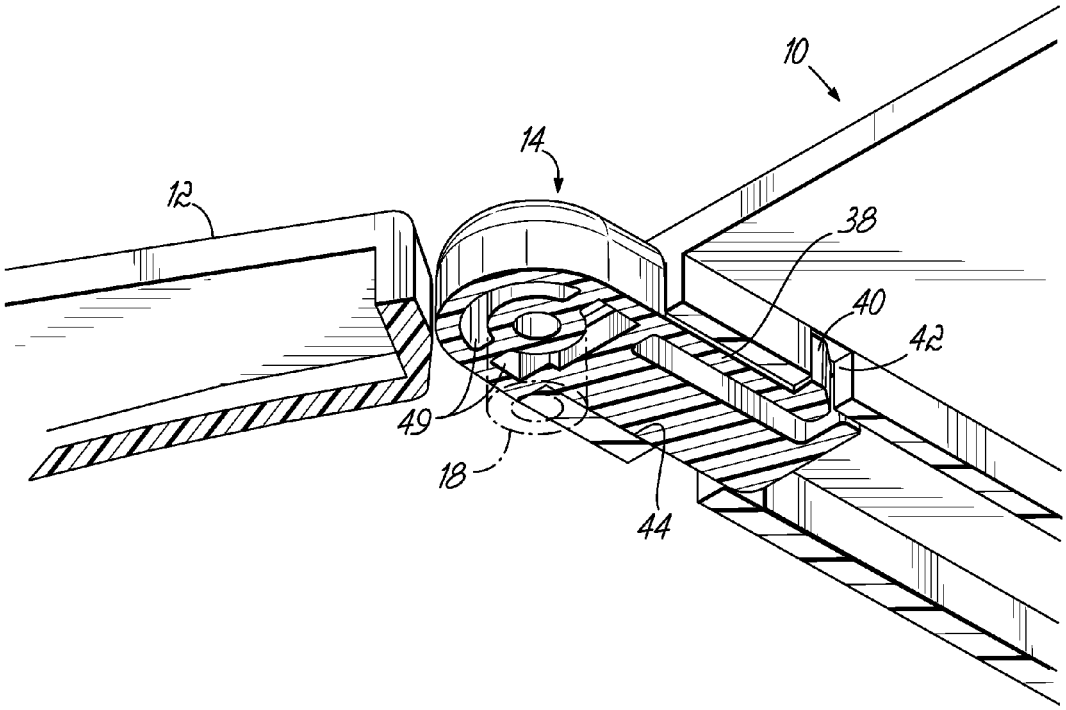
Figure 24:
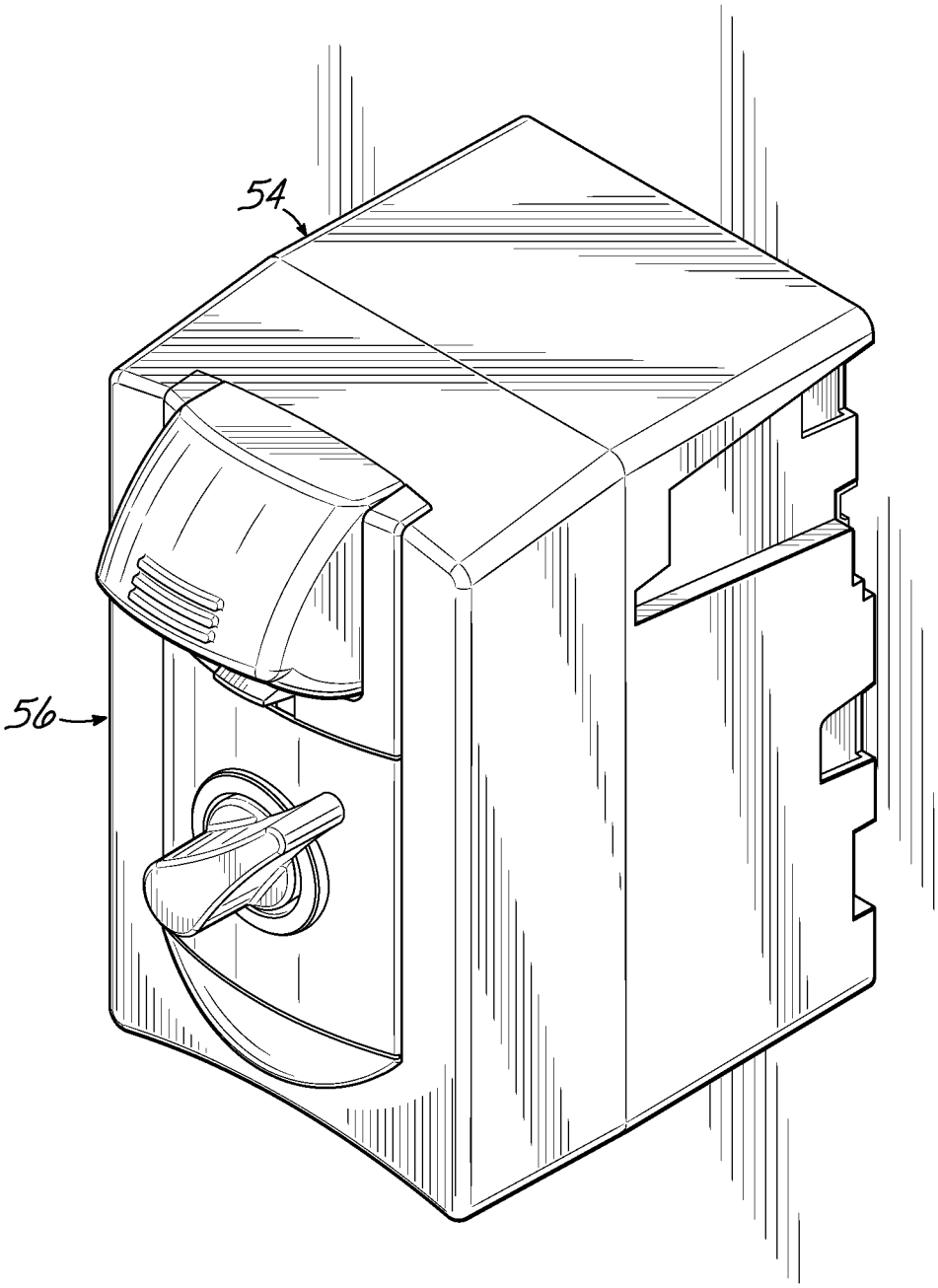

Upper or top hinge 14 is depicted in FIGS. 21-23. It too is constructed to break responsive to stresses on the door and before door failure. Here, the yieldable locking arm 38 with locking lug 40 is disposed on the side of shank 39. Lock lug 40 snaps into a locking aperture 42 extended into track or shank receiving recess 44 in cabinet 10 proximate the upper end of door 12. Otherwise, hinge 14 has a boss 18 and other features, elements and functions like those described for hinge 16.

Accordingly, the invention in one embodiment includes hinge components which are easily field-replaceable upon hinge breakage, presuming authorized access to the cabinet interior. Tools are not required to make the change; only lock lugs 20, 40 are pushed out of apertures 32, 42 to release the hinge shanks 17, 49 for removal and field replacement, respectively.

Hinge 14 may be alternately provided with a series of apertures or slots 49 (shown in FIG. 3, for example), cooperating with lugs (not shown) in the door and in place of boss 18. When door 12 pivots on hinge 14, the lugs move in recesses 49. If broken, hinge 14 is easily replaced by access into a cabinet 10 and depressing lock lug 40 in the field and without need for tools.

Finally, it will be appreciated this cabinet, door and field-replaceable, tool-less hinge can be used in a variety of cabinet and module applications with or without the mounting components of FIGS. 1-15D. This hinge and its functions are particularly useful in easily replacing broken hinges in chemical dispensers or source cabinets where space considerations limit access.

Field Serviceable Chemical Dispenser and Manifold Bracket:

Another aspect of the invention useful with a chemical dispenser cabinet separately from, or together with other aspects of the invention described herein is illustrated in FIGS. 24-27B.

In the past, chemical dispensers include a manifold mounted in a dispenser module or cabinet and particularly to the back wall thereof. Access to the so-mounted manifold for maintenance, repair part replacement or the like is limited. Removal of the manifold from the cabinet is not easy.

This invention thus contemplates a manifold mounting bracket which supports a variety of manifolds releasably mounted in the cabinet but field-removable therefrom, via the removable manifold bracket.

FIG. 24027B depict a chemical dispenser module or cabinet 54 in which this aspect of the invention resides. A pivotable or removable door 56 closes the cabinet 54 and is opened for access to the cabinet interior.

A manifold 58 is mounted in cabinet 54. Manifold 58 includes but is not limited to a chemical eductor 60, a water inlet 62 operable connected to eductor 60 through an on/off water valve 64.

Water valve 64 is operable to pass water from inlet 62 to eductor 60 to draw chemical concentrate through a chemical inlet 65 from a source (not shown) and introduce it to water flowing through eductor 60 to provide a water-diluted chemical mix through discharge tube 66.

Manifold 58 may include other components such as a body or housing and the like.

Figure 25:
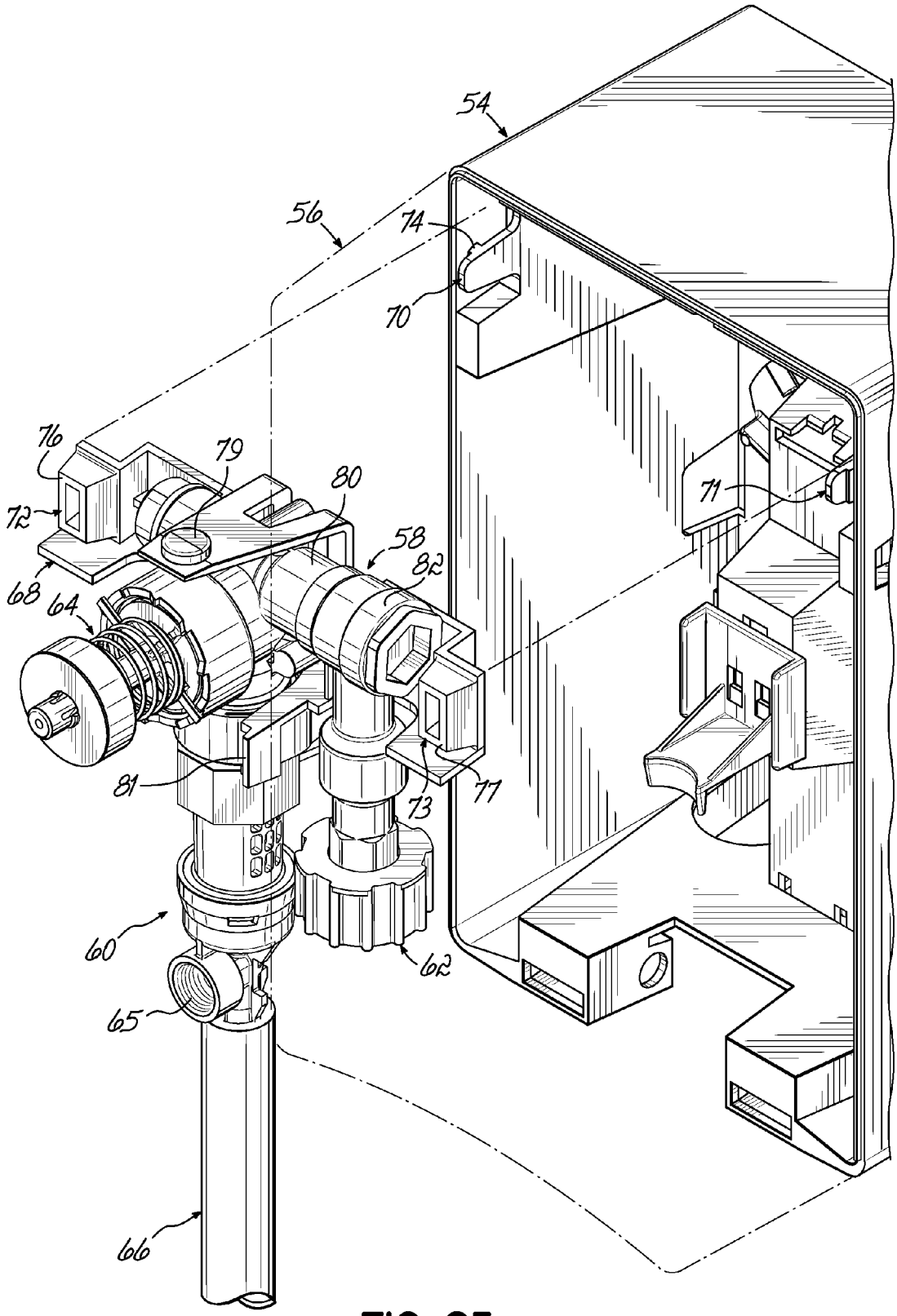
Figure 26A:
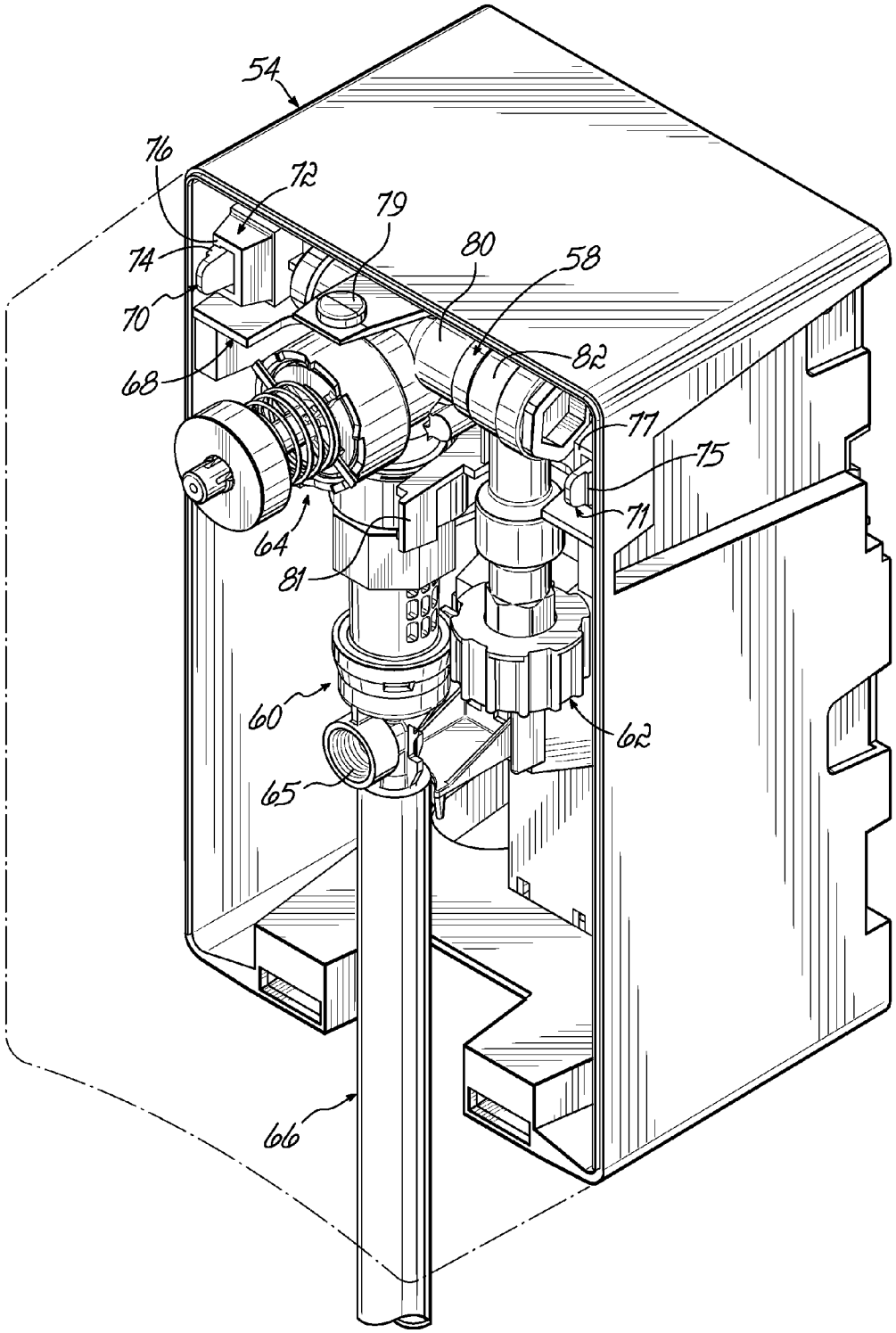
FIG. 26A is an isometric view of a rotatable water inlet member in a chemical dispenser cabinet or module, with the door removed for clarity, and with the water inlet member in a vertical disposition with the cabinet.

A universal manifold bracket 68 supports manifold 58 and is removably mounted in cabinet 54. FIG. 26A depicts the bracket 68 and manifold 58 releasably mounted in cabinet 54, while FIG. 25 illustrates the bracket 68, with manifold 58, disconnected from cabinet 54. The removed bracket/manifold is also depicted in the top view of FIG. 27B, which the mounted position is shown in top view in FIG. 27A.

In this regard, cabinet 54 includes two projections 70, 71 extending forwardly from a portion of cabinet 54. Bracket 68 includes two projection receiving portions 72, 73.

Projections 70, 71 are preferably resilient and include respective locking lugs 74, 75 proximate their ends. Receiving portions 72, 73 include locking shoulders 76, 77. Accordingly, bracket 68 is mountable in cabinet 54 by moving bracket 68 with receiving portions 72, 73 respectively onto and over projections 70, 71.

Projections 70, 71 yield when lock lugs 74, 75 engage the inner tapered portions of receiver portions 72, 73 until log lugs 74, 75 snap over locking shoulders 76, 77, releasably locking bracket 68 and manifold 58 thereon in cabinet 54.

When desired to remove manifold 58, projections 70, 71 are respectively biased inwardly, lugs 74, 75 clear shoulders 76, 77 and the bracket 68 is pulled outwardly of cabinet 54, all performed without tools, and presenting manifold 58 and its components for field service.

Configuration of cabinet 54, projections 70, 71 and bracket 68 may be designed in any suitable way to provide this snap-in assembly and tool-less removal. Of course, access to bracket 68 is only from within cabinet 54, requiring any door thereon to be first opened.

Moreover, it will be appreciated that multiple bracket configurations can be provided for a variety of manifold configurations and designs. Nevertheless, all such brackets have preferably similar cabinet connecting parts, thus allowing a variety of manifolds to be used with customer brackets, but with common cabinet 54.

In other words, a variety of manifolds, varying in configuration and function can all be mounted in the same cabinet through the use of the intermediate removable brackets. It is thus only necessary to provide a bracket for each different manifold and not necessary to make or stock a variety of the more costly and bulkier cabinets 54. One standard cabinet configuration suffices.

It will be appreciated that the manifolds 58 are secured to brackets 68 by any suitable means or by fasteners, clamps or the like, or simply by cooperating snap-together parts. In the embodiment shown, a bracket 68 is secured to a manifold 58 via a fastener 79 and yieldable fork legs 81*a*, 81*b* (FIGS. 27A, 27B) snapped around or supporting components of manifold 58 in any suitable way.

Figure 28:
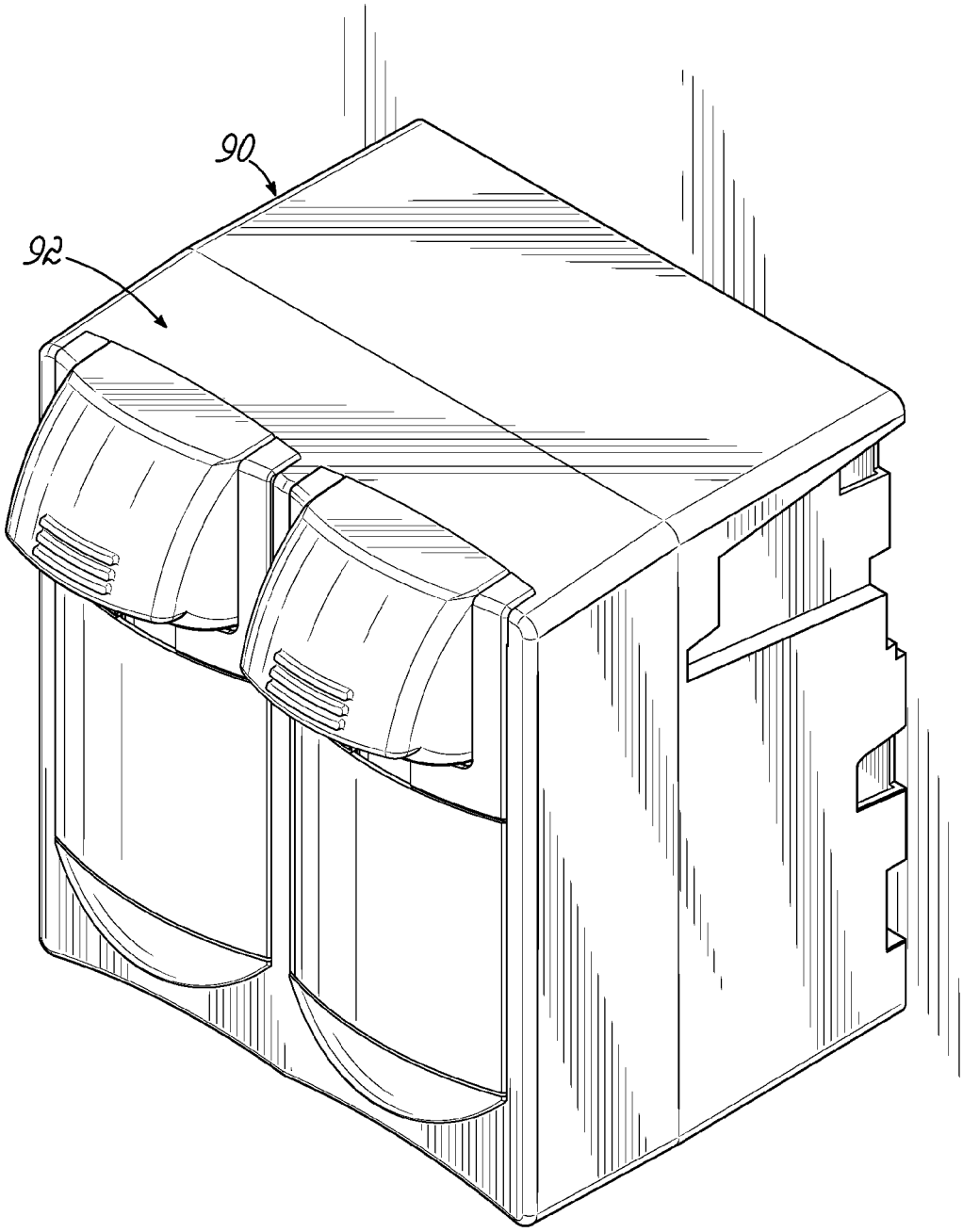
Figure 29A:
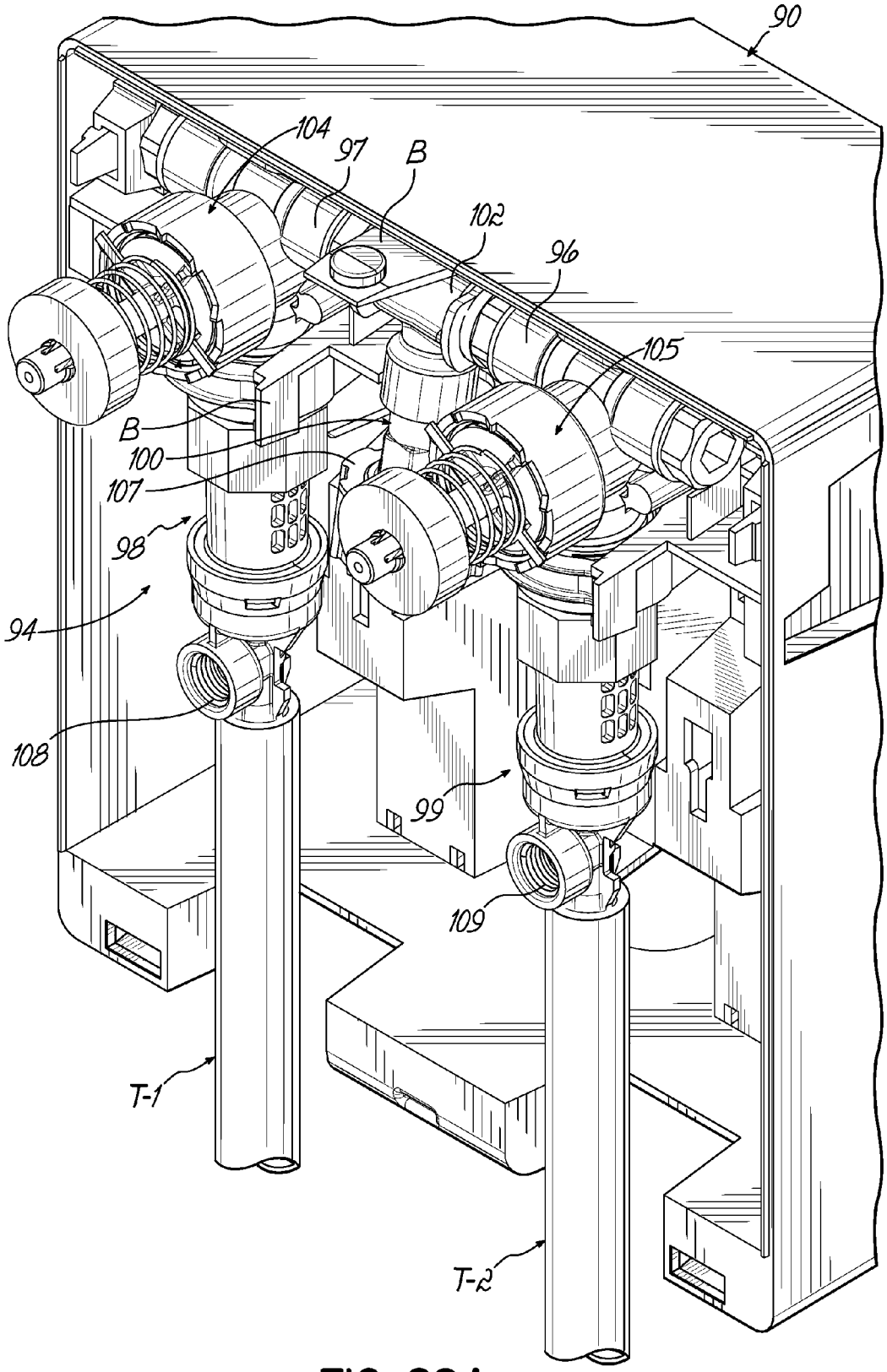
FIG. 29A is an isometric view of the internal area of the cabinet of FIG. 28 showing dual chemical manifolds and a single, rotatably-mounted vertically-disposed water inlet member in the cabinet, with water inlet rotated down to a vertical position.
Figure 29B:
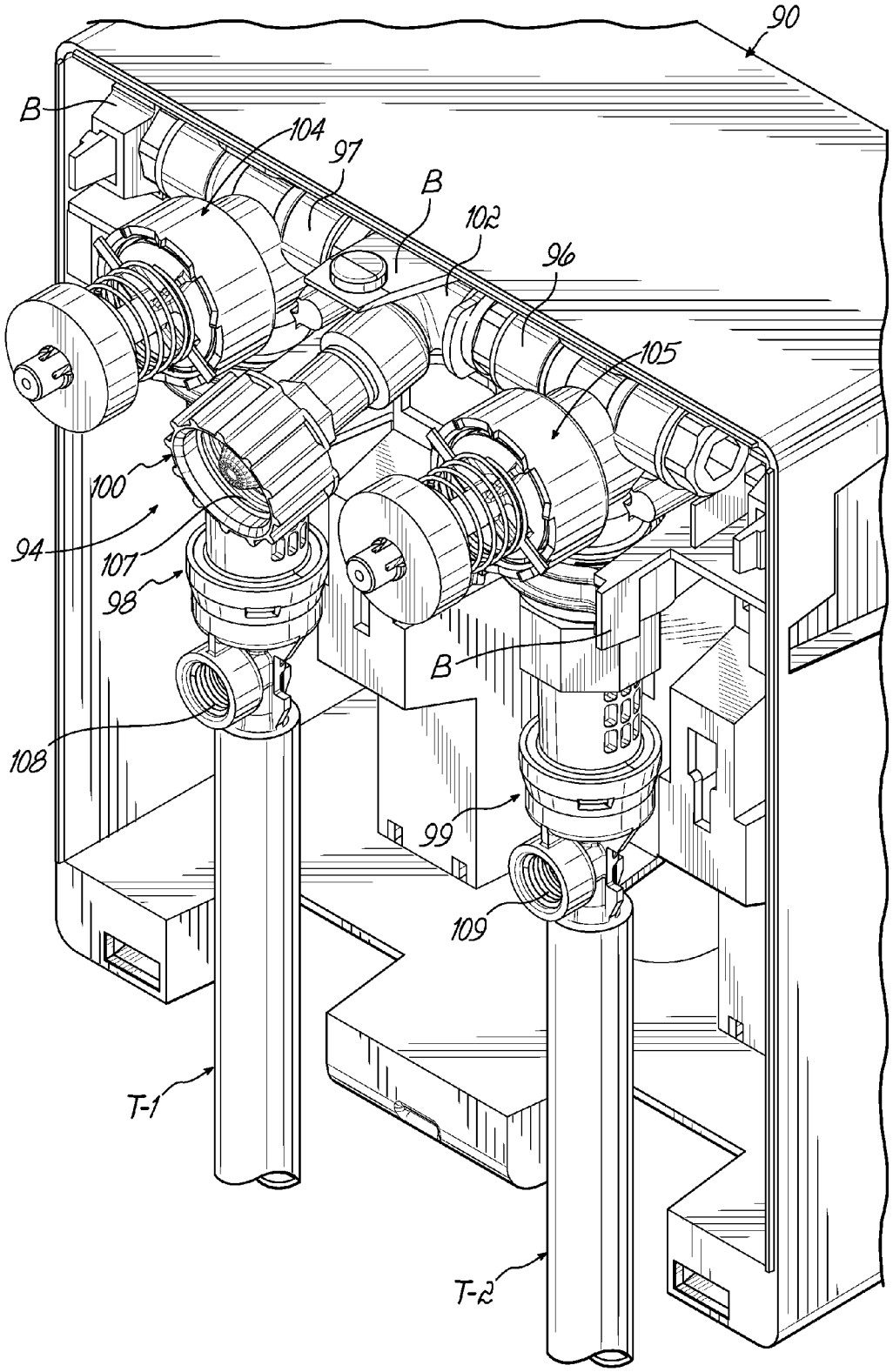

Rotatable Water Inlet:

In another aspect of this invention, embodiments of a rotatable water inlet for a chemical dispenser are illustrated in FIGS. 25-29B where water inlet 62 is rotatable between stowed and extended positions. FIGS. 26A, 26B illustrate a single eductor dispenser with a single rotatable water inlet as in FIGS. 25-29B for example. FIGS. 28-29B illustrate a dual eductor dispenser with a single rotatable water inlet.

Figure 26B:
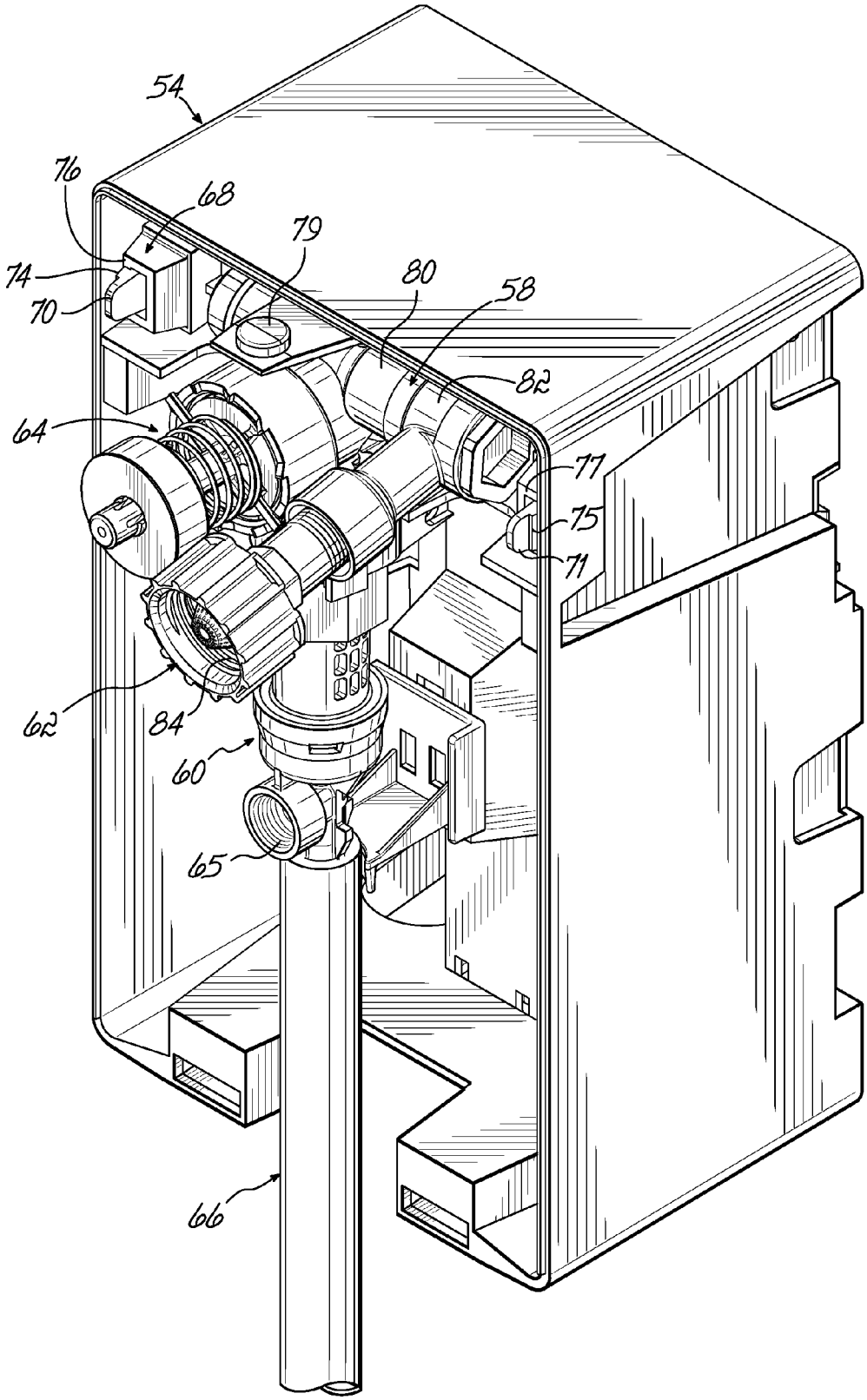
FIG. 26B is an isometric view of the manifold as in FIG. 26A but showing the outwardly rotated water inlet.
Figure 27A:
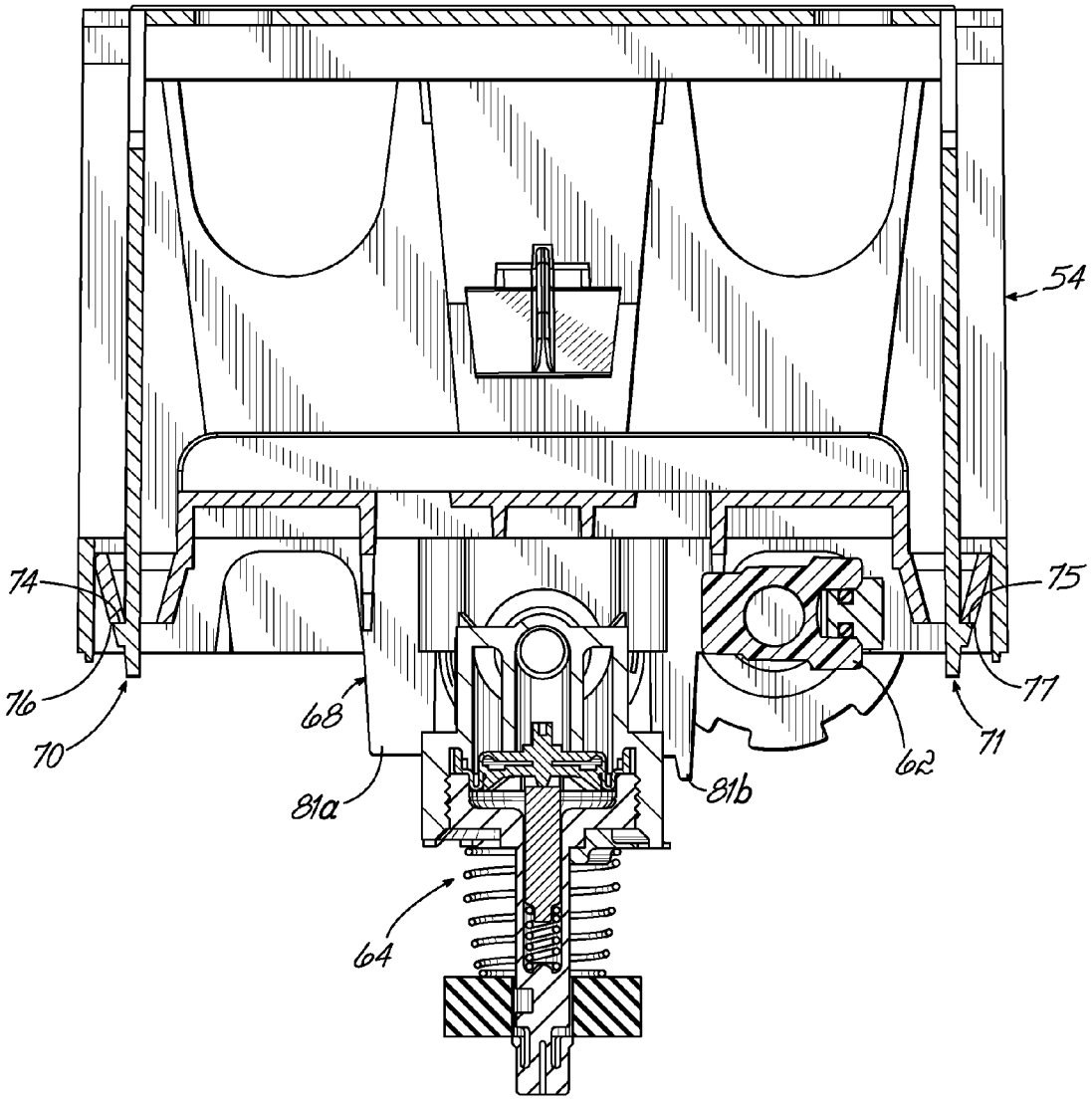
FIG. 27A is a top sectioned view of the bracket and manifold of FIG. 26A.
Figure 27B:
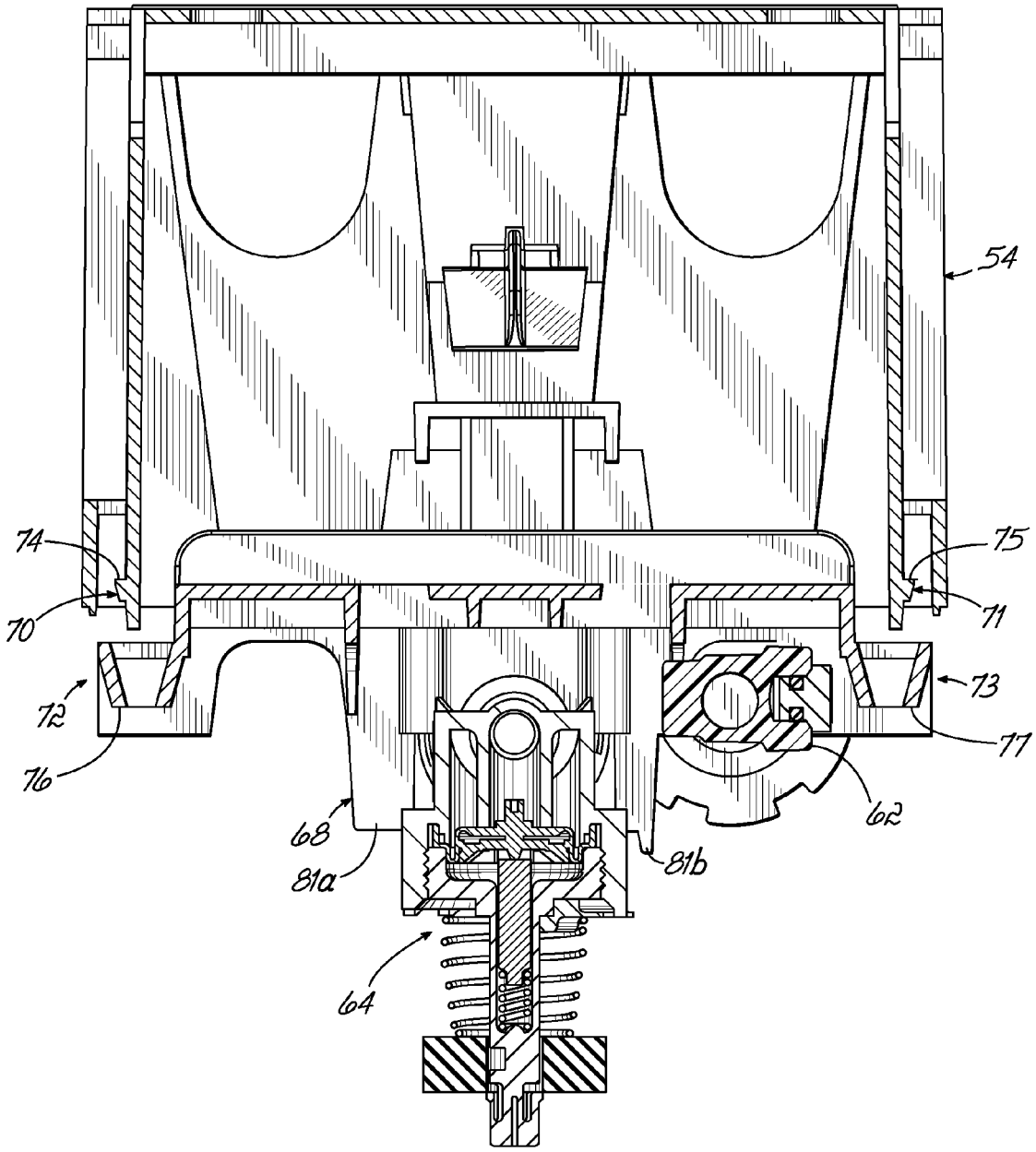
FIG. 27B is a top sectional view of the dismounted bracket and manifold but with the mounting bracket disconnected from the cabinet as in FIG. 25.

It will be appreciated that the embodiment of FIGS. 26A, 26B illustrates this aspect of the invention in a manifold mounted to a cabinet 54 by means of a bracket 68 as in FIGS. 25, 26A. The rotatable water inlet 62 herein can be provided in any manifold, whether mounted in a cabinet 54 or elsewhere by means of a bracket 68 or otherwise. Inlet 62 is operably rotatable about manifold 58 (about the axis thereof) between stowed and extended positions.

The FIGS. depicts a manifold 58 including an eductor 60, a rotatable water inlet or water inlet tube 62 and a water valve 64. A manifold body or housing 80 defines a water passage between inlet 62 and water valve 64.

It will be appreciated that inlet or tube 62 has a rounded body end 82 operably fitted around body 80 in a way to allow inlet 62 to extend in a radial direction from body 82, and to be rotated about an axis of a water passage in body 82 while operably connected thereto as those of skill will appreciate.

In one position, inlet 62 hangs vertically (FIG. 26A) in cabinet 54. It is rotatable to another non-vertical position (FIG. 26B) which can be horizontally extended.

In this manner, when any door to cabinet 54 is opened, inlet 62 can be rotated outwardly to facilitate inter-connection to a water supply via threaded fitting 84. Thereafter, the inlet 62 is rotated to its vertical position (FIG. 26A) and out of the way to receive water from below the cabinet. A water hose, not shown, extends to inlet 62 through the same opening accommodating discharge tube 66. In this way, the inlet 62 can be rotated outwardly to facilitate manipulation to connect a hose, then inwardly for operation with inlet 62 and the hose extended downwardly.

In an alternative embodiment, shown in FIGS. 28-29B, a dual eductor dispenser 90 is served by a single rotatable water inlet or tube 100. In this embodiment, a dual eductor or housing 90 is provided with a front door 92, behind which resides a dual inductor manifold 194.

Manifold 94 includes manifold bodies 96, 97, each operably connected to a respective eductor 98, 99 through water valves 104, 105. Manifold bodies 96, 97 are each operably connected to a water inlet tube 100 having a fitting 102 rotatably and operably connecting tube 100 to both manifold bodies 96, 97. Water passing through tube 100 passes through both manifold bodies 96, 97 and to respective eductors 98, 99 when valves 104, 105 are opened.

Tube 100 normally hangs vertically in one position (FIG. 29A). The tube 100 can be rotated to a non-vertical position (FIG. 29B) when door 92 is open to facilitate a hose connection to tube 100 through fitting 107. Thereafter, the tube 100 is returned to a vertical position, out of the way, to receive water through a hose (not shown) from below the cabinet.

In use, water flows through inlet 100 via passages in fittings 102 through manifolds 96, 97, valves 104, 105 and eductors 98, 99, drawing chemical concentrates through inlets 108, 109 on each eductor for discharge through respective discharge tubes T-1 and T-2.

As in the previous embodiment, dual manifold 94 can optionally be releasably secured to cabinet 90 via any appropriately configured bracket B similarly to that releasable manifold mounting as described above, so that the dual manifold 94 can be removed from the cabinet for field servicing.

Accordingly, the invention contemplates specific operational structures and methods which greatly facilitate the construction, mounting, maintenance, repair and use of chemical dispensers and sources in combined areas. These operational features include modular mounting, field replaceable hinges, field serviceable, tool-less manifold assemblies provided by removable manifold brackets and rotatable water inlets facilitating water supply connection and feed.

All these features can be advantageously used, either singly or in any combination, one with the other, or all together to facilitate and provide improved chemical dispensing systems and processes.

What is claimed is:

1. A chemical dispensing apparatus comprising:

a cabinet;

a cabinet door;

at least one hinge pivotally securing said door to said cabinet, said hinge comprising a shank releasably secured to one of said cabinet and said door and a hinge pivot member releasably secured to the other of said cabinet and said door;

a chemical manifold;

a chemical manifold bracket releasably secured within said cabinet, said manifold mounted on said bracket and removable from said cabinet with said bracket; and a water inlet rotationally and operably connected to said manifold and extending therefrom, said inlet rotatable between a vertical position and a non-vertical position.

2. Apparatus as in claim 1 further including:

a plurality of horizontally-oriented mounting rails;

a rail connector extending between at least two of said horizontally-oriented mounting rails; and said cabinet releasably mounted on said at least two said horizontally-oriented mounting rails.

* * * * *